US008113300B2

(12) United States Patent
Tibbitts

(10) Patent No.: US 8,113,300 B2
(45) Date of Patent: Feb. 14, 2012

(54) IMPACT EXCAVATION SYSTEM AND METHOD USING A DRILL BIT WITH JUNK SLOTS

(75) Inventor: Gordon Tibbitts, Salt Lake City, UT (US)

(73) Assignee: PDTI Holdings, LLC, Houston, TX (US)

( * ) Notice: Subject to any disclaimer, the term of this patent is extended or adjusted under 35 U.S.C. 154(b) by 189 days.

(21) Appl. No.: 12/363,119

(22) Filed: Jan. 30, 2009

(65) Prior Publication Data

US 2009/0223718 A1 Sep. 10, 2009

(51) Int. Cl.
*E21B 7/16* (2006.01)

(52) U.S. Cl. ..... 175/67; 175/54; 175/424; 175/380

(58) Field of Classification Search ..... 166/67, 166/54, 424, 380; 175/67, 54, 424, 380
See application file for complete search history.

(56) References Cited

U.S. PATENT DOCUMENTS

| | | | | |
|---|---|---|---|---|
| 2,626,779 | A | 1/1953 | Armentrout | |
| 2,724,574 | A | 11/1955 | Ledgerwood, Jr. | |
| 2,727,727 | A * | 12/1955 | Williams | 175/54 |
| 2,728,557 | A | 12/1955 | McNatt | |
| 2,735,654 | A * | 2/1956 | Hildebrandt | 175/54 |
| 2,761,651 | A | 9/1956 | Ledgerwood, Jr. | |
| 2,779,571 | A | 1/1957 | Ortloff | |
| 2,807,442 | A | 9/1957 | Ledgerwood, Jr. | |
| 2,809,013 | A | 10/1957 | Ledgerwood, Jr. et al. | |
| 2,815,931 | A | 12/1957 | Williams | |
| 2,841,365 | A | 7/1958 | Ramsey et al. | |
| 2,868,509 | A | 1/1959 | Williams | |
| 2,954,122 | A | 9/1960 | Colburn | |
| 3,001,652 | A | 9/1961 | Schroeder et al. | |
| 3,055,442 | A | 9/1962 | Prince | |
| 3,084,752 | A | 4/1963 | Tiraspolsky | |
| 3,093,420 | A | 6/1963 | Levene et al. | |
| 3,112,800 | A | 12/1963 | Bobo | |
| 3,132,852 | A | 5/1964 | Dolbear | |
| 3,322,214 | A | 5/1967 | Buck | |
| 3,374,341 | A | 3/1968 | Klotz | |
| 3,384,192 | A * | 5/1968 | Goodwin et al. | 175/424 |

(Continued)

FOREIGN PATENT DOCUMENTS

CA 2522568 A1 11/2004

(Continued)

OTHER PUBLICATIONS

*Curlett Family Limited Partnership, Ltd.*, Plaintiff v. *Particle Drilling Technologies, Inc.*, a Delaware Corporation; and *Particle Drilling Technologies, Inc.*, a Nevada Corporation; Affidavit of Harry (Hal B. Curlett); May 3, 2006; 8 pages.

(Continued)

*Primary Examiner* — Nicole Coy
(74) *Attorney, Agent, or Firm* — Vedder Price P.C.

(57) ABSTRACT

A method and system for excavating a subterranean formation including pumping a fluid through a nozzle such that an exit velocity of the fluid is greater than an entrance velocity of the fluid. A plurality of solid material impactors may be circulated with the fluid through the nozzle. A substantial portion by weight of the solid material impactors has a mean diameter of approximately 0.100 inches or less. The substantial portion by weight of solid material impactors exit the nozzle, contact the formation and rebound into a junk slot.

14 Claims, 9 Drawing Sheets

U.S. PATENT DOCUMENTS

| | | | | |
|---|---|---|---|---|
| 3,385,386 | A | | 5/1968 | Goodwin et al. |
| 3,389,759 | A | | 6/1968 | Mori et al. |
| 3,402,780 | A | * | 9/1968 | Goodwin et al. ..... 175/67 |
| 3,416,614 | A | | 12/1968 | Goodwin et al. |
| 3,424,255 | A | | 1/1969 | Mori et al. |
| 3,469,642 | A | | 9/1969 | Goodwin et al. |
| 3,542,142 | A | | 11/1970 | Hasiba et al. |
| 3,548,959 | A | | 12/1970 | Hasiba et al. |
| 3,560,053 | A | | 2/1971 | Ortloff |
| 3,576,221 | A | | 4/1971 | Hasiba |
| 3,645,346 | A | | 2/1972 | Miller et al. |
| 3,688,852 | A | | 9/1972 | Gaylord et al. |
| 3,688,859 | A | | 9/1972 | Maurer |
| 3,704,966 | A | | 12/1972 | Beck, Jr. |
| 3,838,742 | A | | 10/1974 | Juvkam-Wold |
| 3,852,200 | A | | 12/1974 | Meyer |
| 3,865,202 | A | | 2/1975 | Takahashi et al. |
| 3,924,698 | A | | 12/1975 | Juvkam-Wold |
| 4,042,048 | A | | 8/1977 | Schwabe |
| 4,067,617 | A | | 1/1978 | Bunnelle |
| 4,141,592 | A | | 2/1979 | Lavon |
| 4,304,609 | A | | 12/1981 | Morris |
| 4,391,339 | A | | 7/1983 | Johnson, Jr. et al. |
| 4,444,277 | A | | 4/1984 | Lewis |
| 4,476,027 | A | | 10/1984 | Fox |
| 4,490,078 | A | | 12/1984 | Armstrong |
| 4,492,276 | A | | 1/1985 | Kamp |
| 4,497,598 | A | | 2/1985 | Blanton |
| 4,498,987 | A | | 2/1985 | Inaba |
| 4,534,427 | A | | 8/1985 | Wang et al. |
| 4,624,327 | A | | 11/1986 | Reichman |
| 4,627,502 | A | | 12/1986 | Dismukes |
| 4,681,264 | A | | 7/1987 | Johnson |
| 4,699,548 | A | | 10/1987 | Bergstrom |
| 4,768,709 | A | | 9/1988 | Yie |
| 4,809,791 | A | | 3/1989 | Hayatdavoudi |
| 4,825,963 | A | | 5/1989 | Ruhle |
| 5,199,512 | A | | 4/1993 | Curlett |
| 5,291,957 | A | | 3/1994 | Curlett |
| 5,355,967 | A | | 10/1994 | Mueller et al. |
| 5,421,420 | A | | 6/1995 | Malone et al. |
| 5,542,486 | A | | 8/1996 | Curlett |
| 5,718,298 | A | | 2/1998 | Rusnak |
| 5,799,734 | A | | 9/1998 | Norman et al. |
| 5,862,871 | A | | 1/1999 | Curlett |
| 5,881,830 | A | | 3/1999 | Cooley |
| 5,897,062 | A | | 4/1999 | Enomoto et al. |
| 5,944,123 | A | | 8/1999 | Johnson |
| 6,003,623 | A | | 12/1999 | Miess |
| 6,142,248 | A | | 11/2000 | Thigpen et al. |
| 6,152,356 | A | | 11/2000 | Minden |
| 6,216,801 | B1 | | 4/2001 | Jonnes |
| 6,345,672 | B1 | | 2/2002 | Dietzen |
| 6,347,675 | B1 | | 2/2002 | Kolle |
| 6,386,300 | B1 | | 5/2002 | Curlett et al. |
| 6,474,418 | B2 | | 11/2002 | Miramon |
| 6,506,310 | B2 | | 1/2003 | Kulbeth |
| 6,530,437 | B2 | | 3/2003 | Maurer et al. |
| 6,533,946 | B2 | | 3/2003 | Pullman |
| 6,571,700 | B2 | | 6/2003 | Nakamura et al. |
| 6,581,700 | B2 | | 6/2003 | Curlett et al. |
| 6,651,822 | B2 | | 11/2003 | Alanis |
| 6,732,797 | B1 | | 5/2004 | Watters et al. |
| 6,904,982 | B2 | | 6/2005 | Judge et al. |
| 7,090,017 | B2 | | 8/2006 | Justus et al. |
| 7,172,038 | B2 | | 2/2007 | Terry et al. |
| 7,258,176 | B2 | | 8/2007 | Tibbitts et al. |
| 7,343,987 | B2 | | 3/2008 | Tibbitts |
| 7,383,896 | B2 | | 6/2008 | Tibbitts |
| 7,398,838 | B2 | | 7/2008 | Harder et al. |
| 7,398,839 | B2 | | 7/2008 | Harder et al. |
| 7,503,407 | B2 | | 3/2009 | Tibbitts |
| 7,757,786 | B2 | | 7/2010 | Harder et al. |
| 7,793,741 | B2 | | 9/2010 | Harder et al. |
| 7,798,249 | B2 | | 9/2010 | Tibbitts |
| 2002/0011338 | A1 | | 1/2002 | Maurer et al. |
| 2002/0134550 | A1 | | 9/2002 | Leeson et al. |
| 2006/0011386 | A1 | | 1/2006 | Tibbitts |
| 2006/0016622 | A1 | | 1/2006 | Tibbitts |
| 2006/0016624 | A1 | | 1/2006 | Tibbitts |
| 2006/0021798 | A1 | | 2/2006 | Tibbitts |
| 2006/0027398 | A1 | | 2/2006 | Tibbitts |
| 2006/0180350 | A1 | | 8/2006 | Harder |
| 2006/0191717 | A1 | | 8/2006 | Harder et al. |
| 2006/0191718 | A1 | | 8/2006 | Harder et al. |
| 2008/0017417 | A1 | | 1/2008 | Tibbitts |
| 2008/0135300 | A1 | | 6/2008 | James |
| 2008/0156545 | A1 | | 7/2008 | Tibbitts |
| 2008/0196944 | A1 | | 8/2008 | Tibbitts |
| 2008/0210472 | A1 | | 9/2008 | Tibbitts |
| 2008/0230275 | A1 | | 9/2008 | Harder |
| 2009/0038856 | A1 | | 2/2009 | Vuyk |
| 2009/0090557 | A1 | | 4/2009 | Vuyk, Jr. et al. |
| 2009/0126994 | A1 | | 5/2009 | Tibbitts et al. |
| 2009/0200080 | A1 | | 8/2009 | Tibbitts |
| 2009/0200084 | A1 | | 8/2009 | Vuyk |
| 2009/0205871 | A1 | | 8/2009 | Tibbitts |
| 2009/0218098 | A1 | | 9/2009 | Tibbitts et al. |
| 2009/0223718 | A1 | | 9/2009 | Tibbitts |

FOREIGN PATENT DOCUMENTS

| | | | |
|---|---|---|---|
| CA | 2588170 | A1 | 1/2009 |
| EP | 0192016 | A1 | 8/1986 |
| GB | 2385346 | A | 8/2003 |
| GB | 2385346 | B | 9/2004 |
| IQ | 20055376 | | 11/2005 |
| WO | 0225053 | A1 | 3/2002 |
| WO | 0234653 | A | 5/2002 |
| WO | 02092956 | A | 11/2002 |
| WO | 2004094734 | A2 | 11/2004 |
| WO | 2004106693 | A2 | 12/2004 |
| WO | 2009009792 | | 11/2005 |
| WO | 2006001997 | A3 | 2/2006 |
| WO | 2008006005 | A3 | 1/2008 |
| WO | 2008140760 | A1 | 11/2008 |

OTHER PUBLICATIONS

Geddes et al., "Leveraging a New Energy Source to Enhance Heavy-Oil and Oil-Sands Production," Society of Petroleum Engineers, SPE/PS-CIM/CHOA 97781, 2005 (7 pages).
www.particledrilling.com, May 4, 2006.
Anderson, Arthur, "Global E&P Trends" Jul. 1999, (2 pages).
Cohen et al, "High-Pressure Jet Kerf Drilling Shows Significant Potential to Increase ROP", SPE 96557, Oct. 2005, pp. 1-8.
Eckel, et al., "Development and Testing of Jet Pump Pellet Impact Drill Bits," Petroleum Transactions, Aime, 1956, 1-10, vol. 207.
Fair, John, "Development of High-Pressure Abrasive-Jet Drilling", Journal of Petroleum Technology, Aug. 1981, pp. 1379-1388.
Galecki et al., "Steel Shot Entrained Ultra High Pressure Waterjet for Cutting and Drilling in Hard Rocks", pp. 371-388.
Killalea, Mike, High Pressure Drilling System Triples ROPS, Stymies Bit Wear, Drilling Technology, Mar.-Apr. 1989, pp. 10-12.
Kolle et al.; "Laboratory and Field Testing of an Ultra-High-Pressure, Jet-Assisted Drilling System," SPE/IADC 22000, 1991, pp. 847-856.
Ledgerwood, L., "Efforts to Develop Improved Oilwell Drilling Methods," Petroleum Transactions, Aime, 1960, 61-74, vol. 219.
Maurer, William, "Advanced Drilling Techniques," Chapter 5, pp. 19-27, Petroleum Publishing Co., Tulsa, OK. 1980.
Maurer, William, "Impact Crater Formation in Rock," Journal of Applied Physics, Jul. 1960, pp. 1247-1252, vol. 31, No. 7.
Maurer et al., "Deep Drilling Basic Research vol. 1—Summary Report," Gas Research Institute, GRI 90/0265.1, Jun. 1990.
Peterson et al., "A New Look at Bit-Flushing or the Importance of the Crushed Zone in Rock Drilling and Cutting," (20 pages).
Ripken et al., "A Study of the Fragmentation of Rock by Impingement with Water and Solid Impactors," University of Minnesota St. Anthony Falls Hydraulic Laboratory, Feb. 1972, 114 pages.
Review of Mechanical Bit/Rock Interactions, vol. 3, pp. 3-1 to 3-68. Security DBS, 1995, (62 pages).
Singh, Madan, "Rock Breakage by Pellet Impact," IIT Research Institute, Dec. 24, 1969 (92 pages).
Summers et al., "A Further Investigation of DIAjet Cutting," Jet Cutting Technology—Proceedings of the 10th International Conference, 1991, pp. 181-192; Elsevier Science Publishers Ltd, USA.

Summers, David, "Waterjetting Technology," Abrasive Waterjet Drilling, pp. 557-598, Curators' Professor of Mining Engineering and Director High Pressure Waterjet Laboratory University of Missouri-Rolla Missouri, E & FN SPON, London, UK, First Edition 1995 (ISBN 0 419 19660 9).
Veenhuizen, et al., "Ultra-High Pressure Jet Assist of Mechanical Drilling," SPE/IADC 37579, pp. 79-90, 1997.
International Search Report PCT/US04/11578; dated Dec. 28, 2004 (4 pages).
International Preliminary Report of Patentability PCT/US04/11578; dated Oct. 21, 2005 (5 pages).
Written Opinion PCT/US04/11578; dated Dec. 28, 2004 (4 pages).
Examination Report dated May 8, 2007 on GCC Patent No. GCC/P/2004/3505 (4 pages).
Co-pending U.S. Appl. No. 12/172,760, filed Jul. 14, 2008, Titled "Injection System and Method".
Co-pending U.S. Appl. No. 12/120,763, filed May 15, 2008, Titled "Impact Excavation System and Method With Particle Separation".
Co-pending U.S. Appl. No. 12/122,374, filed May 16, 2008, Titled "Impact Excavation System and Method With Injection System".
U.S. Appl. No. 12/363,022, filed Jan. 30, 2009, Tibbitts et al., co-pending application.
U.S. Appl. No. 12/271,514, filed Nov. 14, 2008, Tibbitts et al., co-pending application.
U.S. Appl. No. 12/248,649, filed Oct. 9, 2008, Vuyk Jr. et al., co-pending application.
U.S. Appl. No. 12/120,763, filed May 15, 2008, Tibbitts, co-pending application.
U.S. Appl. No. 11/204,862, filed Aug. 16, 2008, Tibbitts, co-pending application.
U.S. Appl. No. 12/796,377, filed Jun. 8, 2010, Harder et al., co-pending application.
U.S. Appl. No. 11/773,355, filed Jul. 3, 2007, Vuyk Jr. et al., co-pending application.
U.S. Appl. No. 12/641,720, filed Dec. 18, 2009, Tibbitts et al., co-pending application.
U.S. Appl. No. 12/752,897, filed Apr. 1, 2010, Tibbitts, co-pending application.
U.S. Appl. No. 10/558,181, filed Nov. 22, 2005, Tibbitts, co-pending application.
U.S. Appl. No. 11/801,268, filed May 9, 2007, Tibbitts et al., co-pending application.
U.S. Appl. No. 12/033,829, filed Feb. 19, 2008, Tibbitts, co-pending application.
U.S. Appl. No. 12/172,760, filed Jul. 14, 2008, Vuyk, Jr. et al., co-pending application.
U.S. Appl. No. 12/388,289, filed Feb. 19, 2009, Tibbitts, co-pending application.
Behavior of Suspensions and Emulsion in Drilling Fluids, Nordic Rheology Society, Jun. 14-15, 2007.
Colby, RH., Viscoelasticity of Structured Fluids, Corporate Research Laboratories, Eastman Kodak Company, Rochester, New York.
Rheo-Plex Product Information Seet, Scomi, Oiltools, 2 pages.
Gelpex Product Information Sheet, Miswaco, 2 pages.
Drilplex Product Information Sheet, Miswaco, 2 pages.
Drilplex System Successfully Mills Casing Windows Offshore Egypt Performance Report, Miswaco, 2 pages.
Drillplex The Versatile Water-Base System With Exceptional Rheological Properties Designed to Lower Costs in a Wide Range of Wells Product Information Sheet, Miswaco, 6 pages.
International Preliminary Report on Patentability dated Nov. 19, 2009 on PCT/US08/05955, 5 pages.
International Preliminary Report on Patentability on PCT/US2009/032654 dated Apr. 17, 2009, 6 pages.
International Search Report dated Dec. 30, 2009 on PCT/US2009/032654, 1 page.
International Search Report PCT/US05/25092; Dated Mar. 6, 2006.
Written Opinion PCT/US05/25092; Dated Mar. 6, 2006.
File history of European Patent Application No. 04759869.3.
File history of European Patent Application No. 5771403.2.
File history of GCC Patent Application No. 2005/5376.
File history of Iraq Patent Application No. 98/2005.
File history of Norwegian Patent Application No. 20070997.
File history of Venezuelan Patent Application No. 1484-05.
File history of Canadian Patent Application No. 2,588,170.
File history of Canadian Patent Application No. 2,522,568.
File history of Iraq Patent Application No. 34/2004.
File history of Norwegian Patent Application No. 20055409.
File history of GCC Patent Application No. 2004/3659.
International Preliminary Report on Patentability dated Jan. 12, 2010 on PCT/US08/69972, 5 pages.
International Search Report dated Sep. 18, 2008 on PCT/US07/72794, 1 page.
International Preliminary Report on Patentability dated Oct. 9, 2008 on PCT/US08/69972, 5 pages.

* cited by examiner

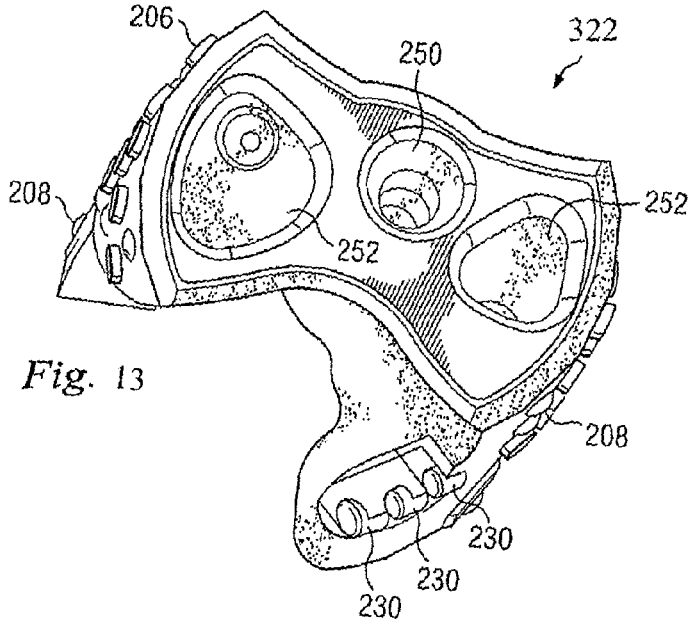
*Fig.* 13
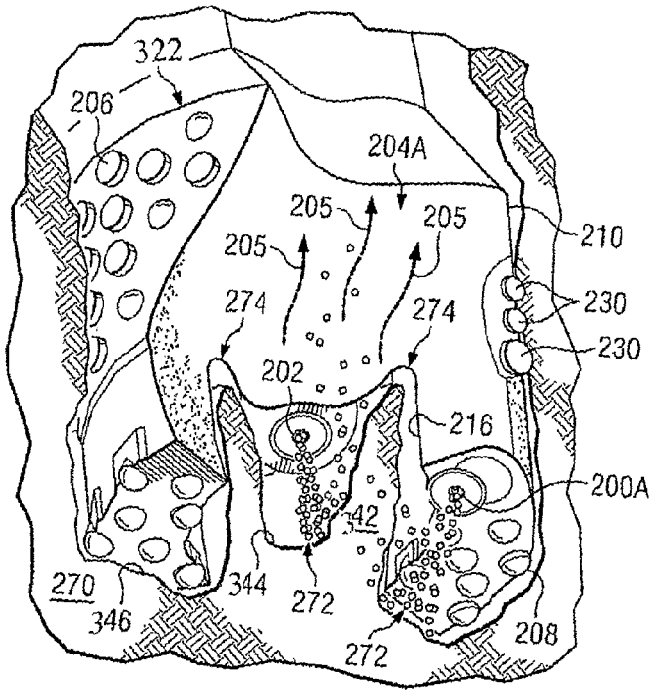
*Fig.* 14

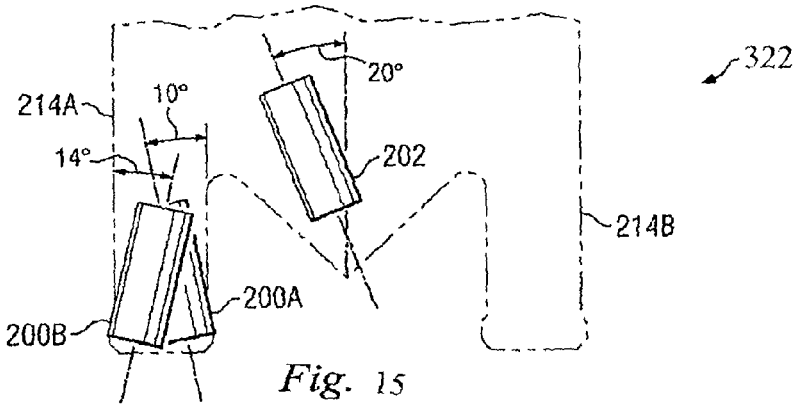
*Fig.* 15
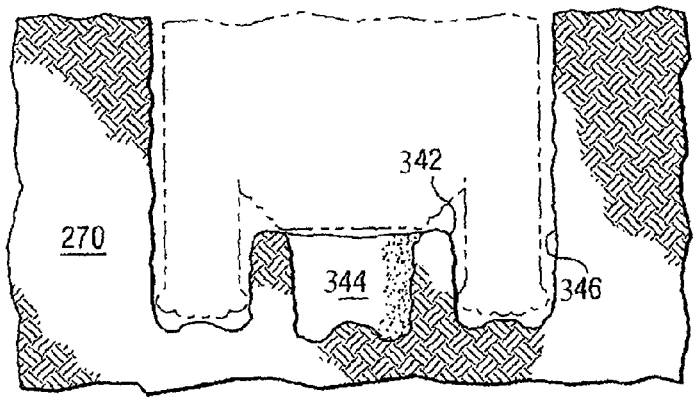
*Fig.* 16
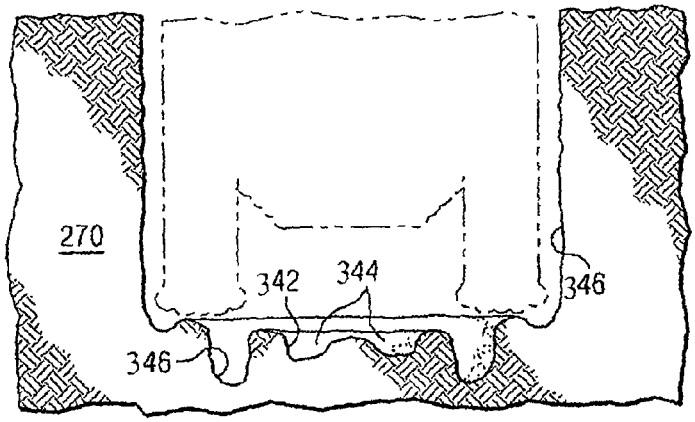
*Fig.* 17

IMPACT EXCAVATION SYSTEM AND METHOD USING A DRILL BIT WITH JUNK SLOTS

CROSS-REFERENCE TO RELATED APPLICATIONS

This application claims priority from and the benefit of U.S. application Ser. No. 10/897,196, filed Jul. 22, 2004, which is a continuation-in-part of U.S. application Ser. No. 10/825,338, filed Apr. 15, 2004 now U.S. Pat. No. 7,503,407, which is a non-provisional of U.S. Application No. 60/463,903 filed Apr. 16, 2003, the full disclosure of each of the foregoing is hereby incorporated by reference herein.

STATEMENT REGARDING FEDERALLY SPONSORED RESEARCH OR DEVELOPMENT

Not Applicable.

BACKGROUND

The process of excavating a wellbore or cutting a formation to construct a tunnel and other subterranean earthen excavations is a very interdependent process that preferably integrates and considers many variables to ensure a usable bore is constructed. As is commonly known in the art, many variables have an interactive and cumulative effect of increasing drilling costs. These variables may include formation hardness, abrasiveness, pore pressures, and formation elastic properties. In drilling wellbores, formation hardness and a corresponding degree of drilling difficulty may increase exponentially as a function of increasing depth. A high percentage of the costs to drill a well are derived from interdependent operations that are time sensitive, i.e., the longer it takes to penetrate the formation being drilled, the more it costs. One of the most important factors affecting the cost of drilling a wellbore is the rate at which the formation can be penetrated by the drill bit, which typically decreases with harder and tougher formation materials and formation depth.

There are generally two categories of modern drill bits that have evolved from over a hundred years of development and untold amounts of dollars spent on the research, testing and iterative development. These are the commonly known as the fixed cutter drill bit and the roller cone drill bit. Within these two primary categories, there are a wide variety of variations, with each variation designed to drill a formation having a general range of formation properties. These two categories of drill bits generally constitute the bulk of the drill bits employed to drill oil and gas wells around the world.

Each type of drill bit is commonly used where its drilling economics are superior to the other. Roller cone drill bits can drill the entire hardness spectrum of rock formations. Thus, roller cone drill bits are generally run when encountering harder rocks where long bit life and reasonable penetration rates are important factors on the drilling economics. Fixed cutter drill bits, on the other hand, are used to drill a wide variety of formations ranging from unconsolidated and weak rocks to medium hard rocks.

In the case of creating a borehole with a roller cone type drill bit, several actions effecting rate of penetration (ROP) and bit efficiency may be occurring. The roller cone bit teeth may be cutting, milling, pulverizing, scraping, shearing, sliding over, indenting, and fracturing the formation the bit is encountering. The desired result is that formation cuttings or chips are generated and circulated to the surface by the drilling fluid. Other factors may also affect ROP, including formation structural or rock properties, pore pressure, temperature, and drilling fluid density. When a typical roller cone rock bit tooth presses upon a very hard, dense, deep formation, the tooth point may only penetrate into the rock a very small distance, while also at least partially, plastically "working" the rock surface.

One attempt to increase the effective rate of penetration (ROP) involved high-pressure circulation of a drilling fluid as a foundation for potentially increasing ROP. It is common knowledge that hydraulic power available at the rig site vastly outweighs the power available to be employed mechanically at the drill bit. For example, modern drilling rigs capable of drilling a deep well typically have in excess of 3000 hydraulic horsepower available and can have in excess of 6000 hydraulic horsepower available while less than one-tenth of that hydraulic horsepower may be available at the drill bit. Mechanically, there may be less than 100 horsepower available at the bit/rock interface with which to mechanically drill the formation.

An additional attempt to increase ROP involved incorporating entrained abrasives in conjunction with high pressure drilling fluid ("mud"). This resulted in an abrasive laden, high velocity jet assisted drilling process. Work done by Gulf Research and Development disclosed the use of abrasive laden jet streams to cut concentric grooves in the bottom of the hole leaving concentric ridges that are then broken by the mechanical contact of the drill bit. Use of entrained abrasives in conjunction with high drilling fluid pressures caused accelerated erosion of surface equipment and an inability to control drilling mud density, among other issues. Generally, the use of entrained abrasives was considered practically and economically unfeasible. This work was summarized in the last published article titled "Development of High Pressure Abrasive-Jet Drilling," authored by John C. Fair, Gulf Research and Development. It was published in the Journal of Petroleum Technology in the May 1981 issue, pages 1379 to 1388.

Another effort to utilize the hydraulic horsepower available at the bit incorporated the use of ultra-high pressure jet assisted drilling. A group known as FlowDril Corporation was formed to develop an ultra-high-pressure liquid jet drilling system in an attempt to increase the rate of penetration. The work was based upon U.S. Pat. No. 4,624,327 and is documented in the published article titled "Laboratory and Field Testing of an Ultra-High Pressure, Jet-Assisted Drilling System" authored by J. J. Kolle, Quest Integrated Inc., and R. Otta and D. L. Stang, FlowDril Corporation; published by SPE/IADC Drilling Conference publications paper number 22000. The cited publication disclosed that the complications of pumping and delivering ultra-high-pressure fluid from surface pumping equipment to the drill bit proved both operationally and economically unfeasible.

Another effort at increasing rates of penetration by taking advantage of hydraulic horsepower available at the bit is disclosed in U.S. Pat. No. 5,862,871. This development employed the use of a specialized nozzle to excite normally pressured drilling mud at the drill bit. The purpose of this nozzle system was to develop local pressure fluctuations and a high speed, dual jet form of hydraulic jet streams to more effectively scavenge and clean both the drill bit and the formation being drilled. It is believed that these hydraulic jets were able to penetrate the fracture plane generated by the mechanical action of the drill bit in a much more effective manner than conventional jets were able to do. ROP increases from 50% to 400% were field demonstrated and documented in the field reports titled "DualJet Nozzle Field Test Report-Security DBS/Swift Energy Company," and "DualJet Nozzle Equipped M-1LRG Drill Bit Run". The ability of the dual jet ("DualJet") nozzle system to enhance the effectiveness of the drill bit action to increase the ROP required that the drill bits first initiate formation indentations, fractures, or both. These features could then be exploited by the hydraulic action of the DualJet nozzle system.

Due at least partially to the effects of overburden pressure, formations at deeper depths may be inherently tougher to drill due to changes in formation pressures and rock properties, including hardness and abrasiveness. Associated in-situ forces, rock properties, and increased drilling fluid density effects may set up a threshold point at which the drill bit drilling mechanics decrease the drilling efficiency.

Another factor adversely effecting ROP in formation drilling, especially in plastic type rock drilling, such as shale or permeable formations, is a build-up of hydraulically isolated crushed rock material, that can become either mass of reconstituted drill cuttings or a "dynamic filtercake", on the surface being drilled, depending on the formation permeability In the case of low permeability formations, this occurrence is predominantly a result of repeated impacting and re-compacting of previously drilled particulate material on the bottom of the hole by the bit teeth, thereby forming a false bottom. The substantially continuous process of drilling, re-compacting, removing, re-depositing and re-compacting, and drilling new material may significantly adversely effect drill bit efficiency and ROP. The re-compacted material is at least partially removed by mechanical displacement due to the cone skew of the roller cone type drill bits and partially removed by hydraulics, again emphasizing the importance of good hydraulic action and hydraulic horsepower at the bit. For hard rock bits, build-up removal by cone skew is typically reduced to near zero, which may make build-up removal substantially a function of hydraulics. In permeable formations the continuous deposition and removal of the fine cuttings forms a dynamic filtercake that can reduce the spurt loss and therefore the pore pressure in the working area of the bit. Because the pore pressure is reduced and mechanical load is increased from the pressure drop across the dynamic filtercake, drilling efficiency can be reduced.

Disclosed herein is a system for excavating a borehole through a subterranean formation. In one embodiment the system comprises a supply of pressurized fluid mixed with impactors. The impactors may have an average mean diameter of about 0.10 inches. The system of this embodiment includes a drill string in a borehole in communication with the pressurized mixture with a drill bit on its lower end. Nozzles are included on the bit that communicate with the pressurized fluid and impactors mixture from the drill string and are oriented to direct the mixture into excavating contact with the borehole. The drill bit includes a first junk slot formed on a lateral side, the first junk slot is configured so that impactors that rebound from the borehole bottom into and through the junk slot. Optionally, the drill bit can have a second junk slot and wherein at least one nozzle is oriented so that impactors exiting that nozzle contact the borehole bottom surface and rebound into the first junk slot and wherein at least one nozzle is oriented so that impactors exiting that nozzle contact the borehole bottom surface and rebound into the second junk slot. The system may further include a pump with an outlet having the pressurized fluid exiting the outlet, and a supply line connected between the pump outlet and the drill string. An impactor supply may be included in the system that discharges impactors into the supply line. The impactors can be substantially spherical, substantially non-abrasive, and substantially rigid. A substantial portion of the impactors exiting the nozzles have a minimum average kinetic energy so that contacting the formation with the impactors compresses the formation to fracture and structurally alter the formation. Cutting fragments broken from the formation by the impactors' contact can flow through the first junk slot and/or the second junk slot, with the slurry and impactors that rebound from the formation surface. At least one nozzle may be oriented to discharge from the bit bottom, so that rotating the bit excavates a region of the borehole bottom adjacent the borehole outer circumference and wherein at least one nozzle is oriented to discharge from the bit bottom so that rotating the bit excavates a region of the borehole bottom adjacent the borehole axis thereby forms a rock ring on the borehole bottom. Included with the bit of this embodiment are arms projecting from the bit and cutters on the arms, so that rotatingly contacting the rock ring with the arms fractures the rock ring.

Also included herein is an alternative borehole excavating system. This embodiment includes a pump discharging pressurized circulating fluid, a supply line with an inlet connected to the pump discharge and an outlet in fluid communication with a drill string disposed in a borehole, a supply of impactors with diameters ranging up to about 0.10 inches, an impactor injection defined by the impactors flowing into the supply line so that a mixture of circulating fluid and impactors flows in the supply line towards the drill string downstream of the impactor injection, a drill bit in the borehole on the drill string end, nozzles on the drill bit aimed at the borehole bottom and in fluid communication with the drill string to thereby receive the mixture of circulating fluid and impactors and direct the mixture into excavating contact with the borehole bottom, and junk slots on the drill bit lateral side, so that the impactors rebounding from the borehole bottom pass through the junk slots.

Disclosed herein is a method of excavating a borehole through a subterranean formation. The method includes providing an annular drill string in the borehole, the drill string having a drill bit, a junk slot on a lateral side of the drill bit, and nozzles on the drill bit lower end that are in fluid communication with the drill string annulus. This method further includes forming a mixture of pressurized fluid and impactors having diameters ranging up to about 0.10 inches, directing the mixture to the drill string annulus so that the mixture flows to the drill bit and exits the nozzles, and orienting the drill bit in the borehole so that the impactors in the mixture contact the formation and rebound upwards from the formation into the junk slot. A rock ring is formable with the drill bit by discharging the mixture from the nozzles in concentric circular patterns. The rock ring can be fractured by compressive contact with the drill bit. Contacting the formation with the impactors compresses the formation to fracture and structurally alter the formation to thereby excavate the borehole.

BRIEF DESCRIPTION OF THE DRAWINGS

For a more detailed description of the embodiments, reference will now be made to the following accompanying drawings:

FIGS. 12-13 illustrate embodiments of the drill bit of FIG. 5 in overhead perspective views.

FIG. 14 illustrates a perspective partial sectional view of a drill bit using impactors to excavate a borehole.

FIG. 15 provides example drill bit nozzle orientations.

FIGS. 16 and 17 are side sectional views respectively depicting forming and fracturing a rock ring.

DETAILED DESCRIPTION OF THE EMBODIMENTS

Figure 1:
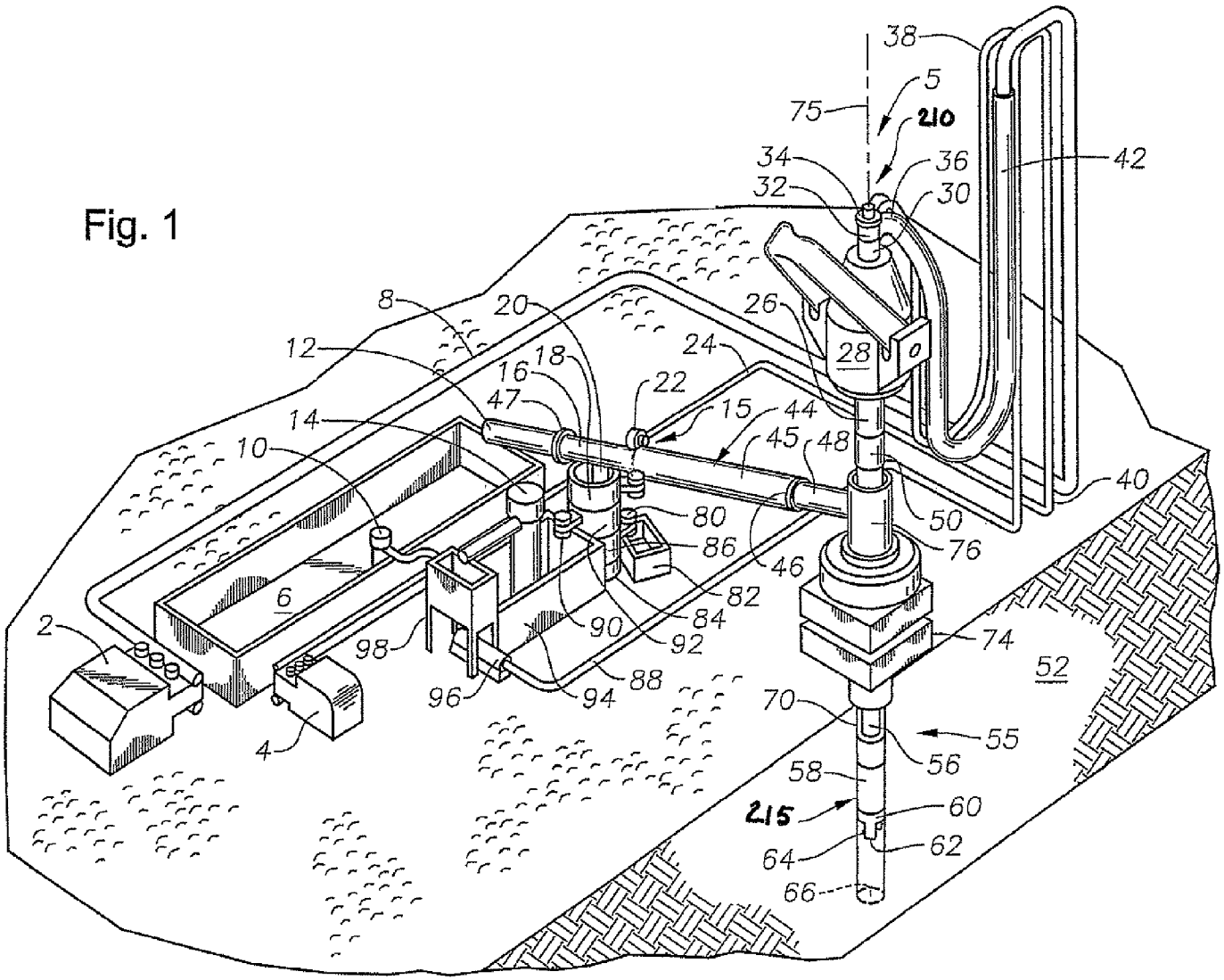
FIG. 1 is an isometric view of an excavation system as used in a preferred embodiment.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above; as well as other features and characteristics described in more detail below, will be readily apparent to those skilled in the art upon reading the following detailed description of the embodiments, and by referring to the accompanying drawings.

Figure 2:
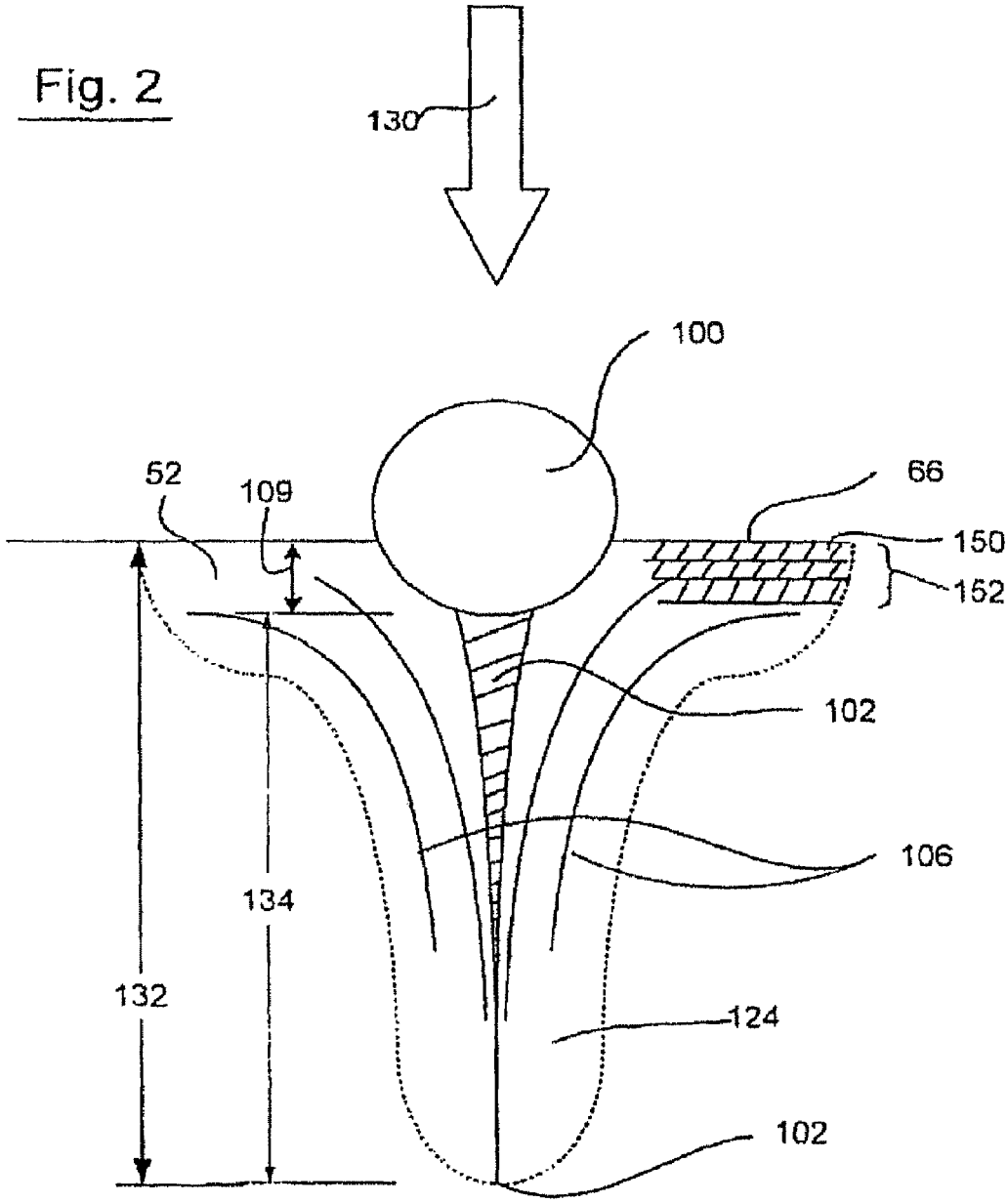
FIG. 2 illustrates an impactor impacted with a formation.

FIGS. 1 and 2 illustrate an embodiment of an excavation system 1 comprising the use of solid material impactors 100 to engage and excavate a subterranean formation 52 to create a wellbore 70. The excavation system 1 may comprise a pipe string 55 comprised of collars 58, pipe 56, and a kelly 50. An upper end of the kelly 50 may interconnect with a lower end of a swivel quill 26. An upper end of the swivel quill 26 may be rotatably interconnected with a swivel 28. The swivel 28 may include a top drive assembly (not shown) to rotate the pipe string 55. Alternatively, the excavation system 1 may further comprise a drill bit 60 to cut the formation 52 in cooperation with the solid material impactors 100. The drill bit 60 may be attached to one end of the pipe string 55 and may engage a bottom surface 66 of the wellbore 70. The drill bit 60 may be a roller cone bit, a fixed cutter bit, an impact bit, a spade bit, a mill, an impregnated bit, a natural diamond bit, or other suitable implement for cutting rock or earthen formation. Referring to FIG. 1, the pipe string 55 may include a feed end 210 located substantially near the excavation rig 5 and a nozzle end 215 including a nozzle 64 supported thereon. The nozzle end 215 may be a bit end 215 and may include the drill bit 60 supported thereon. The excavation system 1 is not limited to excavating a wellbore 70. The excavation system and method may also be applicable to excavating a tunnel, a pipe chase, a mining operation, or other excavation operation wherein earthen material or formation may be removed.

To excavate the wellbore 70, the swivel 28, the swivel quill 26, the kelly 50, the pipe string 55, and a portion of the drill bit 60, if used, may each include an interior passage that allows circulation fluid to circulate through each of the aforementioned components. The circulation fluid may be withdrawn from a tank 6, pumped by a pump 2, through a through medium pressure capacity line 8, through a medium pressure capacity flexible hose 42, through a gooseneck 36, through the swivel 28, through the swivel quill 26, through the kelly 50, through the pipe string 55, and through the bit 60.

The excavation system 1 further comprises at least one nozzle 64 on the end 215 of the pipe string 55 for accelerating at least one solid material impactor 100 as they exit the pipe string 100. The nozzle 64 is designed to accommodate the impactors 100, such as an especially hardened nozzle, a shaped nozzle, or an "impactor" nozzle, which may be particularly adapted to a particular application. The nozzle 64 may be a type that is known and commonly available. The nozzle 64 may further be selected to accommodate the impactors 100 in a selected size range or of a selected material composition. Nozzle size, type, material, and quantity may be a function of the formation being cut, fluid properties, impactor properties, and/or desired hydraulic energy expenditure at the nozzle 64. For example, the nozzle 64 may be a nozzle such as one described in U.S. patent application Ser. No. 10/825,338, filed Apr. 15, 2004 and entitled "Drill Bit", hereby incorporated herein by reference for all purposes. If a drill bit 60 is used, the nozzle or nozzles 64 may be located in the drill bit 60.

The nozzle 64 may alternatively be of a dual-discharge nozzle, such as the dual jet nozzle described in U.S. Pat. No. 5,862,871, hereby incorporated herein by reference for all purposes. Such dual discharge nozzles may generate: (1) a radially outer circulation fluid jet substantially encircling a jet axis, and/or (2) an axial circulation fluid jet substantially aligned with and coaxial with the jet axis, with the dual discharge nozzle directing a majority by weight of the plurality of solid material impactors into the axial circulation fluid jet. A dual discharge nozzle 64 may separate a first portion of the circulation fluid flowing through the nozzle 64 into a first circulation fluid stream having a first circulation fluid exit nozzle velocity, and a second portion of the circulation fluid flowing through the nozzle 64 into a second circulation fluid stream having a second circulation fluid exit nozzle velocity lower than the first circulation fluid exit nozzle velocity. The plurality of solid material impactors 100 may be directed into the first circulation fluid stream such that a velocity of the plurality of solid material impactors 100 while exiting the nozzle 64 is substantially greater than a velocity of the circulation fluid while passing through a nominal diameter flow path in the end 215 of the pipe string 55, to accelerate the solid material impactors 100.

Each of the individual impactors 100 is structurally independent from the other impactors. For brevity, the plurality of solid material impactors 100 may be interchangeably referred to as simply the impactors 100. The plurality of solid material impactors 100 may be substantially rounded and have either a substantially non-uniform outer diameter or a substantially uniform outer diameter. The solid material impactors 100 may be substantially spherically shaped, non-hollow, formed of rigid metallic material, and having high compressive strength and crush resistance, such as steel shot, ceramics, depleted uranium, and multiple component materials. Although the solid material impactors 100 may be substantially a non-hollow sphere, alternative embodiments may provide for other types of solid material impactors, which may include impactors 100 with a hollow interior. The impactors may be substantially rigid and may possess relatively high compressive strength and resistance to crushing or deformation as compared to physical properties or rock properties of a particular formation or group of formations being penetrated by the wellbore 70.

The impactors may be of a substantially uniform mass, grading, or size. The solid material impactors 100 may have any suitable density for use in the excavation system 1. For example, the solid material impactors 100 may have an average density of at least 470 pounds per cubic foot.

The excavation system 1 further comprises at least one nozzle 64 on the end 215 of the pipe string 55 for accelerating at least one solid material impactor 100 as they exit the pipe string 100. The nozzle 64 is designed to accommodate the impactors 100, such as an especially hardened nozzle, a shaped nozzle, or an "impactor" nozzle, which may be particularly adapted to a particular application. The nozzle 64 may be a type that is known and commonly available. The nozzle 64 may further be selected to accommodate the impactors 100 in a selected size range or of a selected material composition. Nozzle size, type, material, and quantity may be a function of the formation being cut, fluid properties, impactor properties, and/or desired hydraulic energy expenditure at the nozzle 64. For example, the nozzle 64 may be a nozzle such as one described in U.S. Pat. No. 7,258,176 issued Aug. 21, 2007 from U.S. patent application Ser. No. 10/825,338, filed Apr. 15, 2004 and entitled "Drill Bit", hereby incorporated herein by reference for all purposes. If a drill bit 60 is used, the nozzle or nozzles 64 may be located in the drill bit 60.

The impactors 100 may be selectively introduced into a fluid circulation system, such as illustrated in FIG. 1, near an excavation rig 5, circulated with the circulation fluid (or "mud"), and accelerated through at least one nozzle 64. "At the excavation rig" or "near an excavation rig" may also include substantially remote separation, such as a separation process that may be at least partially carried out on the sea floor.

Introducing the impactors 100 into the circulation fluid may be accomplished by any of several known techniques. For example, the impactors 100 may be provided in an impactor storage tank 94 near the rig 5 or in a storage bin 82. A screw elevator 14 may then transfer a portion of the impactors at a selected rate from the storage tank 94, into a slurrification tank 98. A pump 10, such as a progressive cavity pump may transfer a selected portion of the circulation fluid from a mud tank 6, into the slurrification tank 98 to be mixed with the impactors 100 in the tank 98 to form an impactor concentrated slurry. An impactor introducer 96 may be included to pump or introduce a plurality of solid material impactors 100 into the circulation fluid before circulating a plurality of impactors 100 and the circulation fluid to the nozzle 64. The impactor introducer 96 may be a progressive cavity pump capable of pumping the impactor concentrated slurry at a selected rate and pressure through a slurry line 88, through a slurry hose 38, through an impactor slurry injector head 34, and through an injector port 30 located on the gooseneck 36, which may be located atop the swivel 28. The swivel 36, including the through bore for conducting circulation fluid therein, may be substantially supported on the feed end 210 of the pipe string 55 for conducting circulation fluid from the gooseneck 36 into the feed end 210 of the pipe string 55. The feed end 210 of the pipe string 55 may also include the kelly 50 to connect the pipe 56 with the swivel quill 26 and/or the swivel 28. The circulation fluid may also be provided with rheological properties sufficient to adequately transport and/or suspend the plurality of solid material impactors 100 within the circulation fluid.

The solid material impactors 100 may also be introduced into the circulation fluid by withdrawing the plurality of solid material impactors 100 from a low pressure impactor source 98 into a high velocity stream of circulation fluid, such as by venturi effect. For example, when introducing impactors 100 into the circulation fluid, the rate of circulation fluid pumped by the mud pump 2 may be reduced to a rate lower than the mud pump 2 is capable of efficiently pumping. In such event, a lower volume mud pump 4 may pump the circulation fluid through a medium pressure capacity line 24 and through the medium pressure capacity flexible hose 40.

The circulation fluid may be circulated from the fluid pump 2 and/or 4, such as a positive displacement type fluid pump, through one or more fluid conduits 8, 24, 40, 42, into the feed end 210 of the pipe string 55. The circulation fluid may then be circulated through the pipe string 55 and through the nozzle 64. The circulation fluid may be pumped at a selected circulation rate and/or a selected pump pressure to achieve a desired impactor and/or fluid energy at the nozzle 64.

The pump 4 may also serve as a supply pump to drive the introduction of the impactors 100 entrained within an impactor slurry, into the high pressure circulation fluid stream pumped by mud pumps 2 and 4. Pump 4 may pump a percentage of the total rate of fluid being pumped by both pumps 2 and 4, such that the circulation fluid pumped by pump 4 may create a venturi effect and/or vortex within the injector head 34 that inducts the impactor slurry being conducted through the line 42, through the injector head 34, and then into the high pressure circulation fluid stream.

From the swivel 28, the slurry of circulation fluid and impactors may circulate through the interior passage in the pipe string 55 and through the nozzle 64. As described above, the nozzle 64 may alternatively be at least partially located in the drill bit 60. Each nozzle 64 may include a reduced inner diameter as compared to an inner diameter of the interior passage in the pipe string 55 immediately above the nozzle 64. Thereby, each nozzle 64 may accelerate the velocity of the slurry as the slurry passes through the nozzle 64. The nozzle 64 may also direct the slurry into engagement with a selected portion of the bottom surface 66 of wellbore 70. The nozzle 64 may also be rotated relative to the formation 52 depending on the excavation parameters. To rotate the nozzle 64, the entire pipe string 55 may be rotated or only the nozzle 64 on the end of the pipe string 55 may be rotated while the pipe string 55 is not rotated. Rotating the nozzle 64 may also include oscillating the nozzle 64 rotationally back and forth as well as vertically, and may further include rotating the nozzle 64 in discrete increments. The nozzle 64 may also be maintained rotationally substantially stationary.

The circulation fluid may be substantially continuously circulated during excavation operations to circulate at least some of the plurality of solid material impactors 100 and the formation cuttings away from the nozzle 64. The impactors 100 and fluid circulated away from the nozzle 64 may be circulated substantially back to the excavation rig 5, or circulated to a substantially intermediate position between the excavation rig 5 and the nozzle 64.

If a drill bit 60 is used, the drill bit 60 may be rotated relative to the formation 52 and engaged therewith by an axial force (WOB) acting at least partially along the wellbore axis 75 near the drill bit 60. The bit 60 may also comprise a plurality of bit cones 62, which also may rotate relative to the bit 60 to cause bit teeth secured to a respective cone to engage the formation 52, which may generate formation cuttings substantially by crushing, cutting, or pulverizing a portion of the formation 52. The bit 60 may also be comprised of a fixed cutting structure that may be substantially continuously engaged with the formation 52 and create cuttings primarily by shearing and/or axial force concentration to fail the formation, or create cuttings from the formation 52. To rotate the bit 60, the entire pipe string 55 may be rotated or only the bit 60 on the end of the pipe string 55 may be rotated while the pipe string 55 is not rotated. Rotating the drill bit 60 may also include oscillating the drill bit 60 rotationally back and forth as well as vertically, and may further include rotating the drill bit 60 in discrete increments.

Also alternatively, the excavation system 1 may comprise a pump, such as a centrifugal pump, having a resilient lining that is compatible for pumping a solid-material laden slurry. The pump may pressurize the slurry to a pressure greater than the selected mud pump pressure to pump the plurality of solid material impactors 100 into the circulation fluid. The impactors 100 may be introduced through an impactor injection port, such as port 30. Other alternative embodiments for the system 1 may include an impactor injector for introducing the plurality of solid material impactors 100 into the circulation fluid.

As the slurry is pumped through the pipe string 55 and out the nozzles 64, the impactors 100 may engage the formation with sufficient energy to enhance the rate of formation removal or penetration (ROP). The removed portions of the formation may be circulated from within the wellbore 70 near the nozzle 64, and carried suspended in the fluid with at least a portion of the impactors 100, through a wellbore annulus between the OD of the pipe string 55 and the ID of the wellbore 70.

At the excavation rig 5, the returning slurry of circulation fluid, formation fluids (if any), cuttings, and impactors 100 may be diverted at a nipple 76, which may be positioned on a BOP stack 74. The returning slurry may flow from the nipple 76, into a return flow line 15, which maybe comprised of tubes 48, 45, 16, 12 and flanges 46, 47. The return line 15 may include an impactor reclamation tube assembly 44, as illustrated in FIG. 1, which may preliminarily separate a majority of the returning impactors 100 from the remaining components of the returning slurry to salvage the circulation fluid for recirculation into the present wellbore 70 or another wellbore. At least a portion of the impactors 100 may be separated from a portion of the cuttings by a series of screening devices, such as the vibrating classifiers 84, to salvage a reusable portion of the impactors 100 for reuse to re-engage the formation 52. A majority of the cuttings and a majority of non-reusable impactors 100 may also be discarded.

The reclamation tube assembly 44 may operate by rotating tube 45 relative to tube 16. An electric motor assembly 22 may rotate tube 44. The reclamation tube assembly 44 comprises an enlarged tubular 45 section to reduce the return flow slurry velocity and allow the slurry to drop below a terminal velocity of the impactors 100, such that the impactors 100 can no longer be suspended in the circulation fluid and may gravitate to a bottom portion of the tube 45. This separation function may be enhanced by placement of magnets near and along a lower side of the tube 45. The impactors 100 and some of the larger or heavier cuttings may be discharged through discharge port 20. The separated and discharged impactors 100 and solids discharged through discharge port 20 may be gravitationally diverted into a vibrating classifier 84 or may be pumped into the classifier 84. A pump (not shown) capable of handling impactors and solids, such as a progressive cavity pump may be situated in communication, with the flow line discharge port 20 to conduct the separated impactors 100 selectively into the vibrating separator 84 or elsewhere in the circulation fluid circulation system.

The vibrating classifier 84 may comprise a three-screen section classifier of which screen section 18 may remove the coarsest grade material. The removed coarsest grade material may be selectively directed by outlet 78 to one of storage bin 82 or pumped back into the flow line 15 downstream of discharge port 20. A second screen section 92 may remove a re-usable grade of impactors 100, which in turn may be directed by outlet 90 to the impactor storage tank 94. A third screen section 86 may remove the finest grade material from the circulation fluid. The removed finest grade material may be selectively directed by outlet 80 to storage bin 82, or pumped back into the flow line 15 at a point downstream of discharge port 20. Circulation fluid collected in a lower portion of the classified 84 may be returned to a mud tank 6 for re-use.

The circulation fluid may be recovered for recirculation in a wellbore or the circulation fluid may be a fluid that is substantially not recovered. The circulation fluid may be a liquid, gas, foam, mist, or other substantially continuous or multiphase fluid. For recovery, the circulation fluid and other components entrained within the circulation fluid may be directed across a shale shaker (not shown) or into a mud tank 6, whereby the circulation fluid may be further processed for re-circulation into a wellbore.

The excavation system 1 creates a mass-velocity relationship in a plurality of the solid material impactors 100, such that an impactor 100 may have sufficient energy to structurally alter the formation 52 in a zone of a point of impact. The mass-velocity relationship may be satisfied as sufficient when a substantial portion by weight of the solid material impactors 100 may by virtue of their mass and velocity at the exit of the nozzle 64, create a structural alteration as claimed or disclosed herein. Impactor velocity to achieve a desired effect upon a given formation may vary as a function of formation compressive strength, hardness, or other rock properties, and as a function of impactor size and circulation fluid rheological properties. A substantial portion means at least five percent by weight of the plurality of solid material impactors that are introduced into the circulation fluid.

The impactors 100 for a given velocity and mass of a substantial portion by weight of the impactors 100 are subject to the following mass-velocity relationship. The resulting kinetic energy of at least one impactor 100 exiting a nozzle 64 is at least 0.075 Ft.Lbs or has a minimum momentum of 0.0003 Lbf.Sec.

Kinetic energy is quantified by the relationship of an object's mass and its velocity. The quantity of kinetic energy associated with an object is calculated by multiplying its mass times its velocity squared. To reach a minimum value of kinetic energy in the mass-velocity relationship as defined, small particles such as those found in abrasives and grits, must have a significantly high velocity due to the small mass of the particle. A large particle, however, needs only moderate velocity to reach an equivalent kinetic energy of the small particle because its mass may be several orders of magnitude larger.

The velocity of a substantial portion by weight of the plurality of solid material impactors 100 immediately exiting a nozzle 64 may be as slow as 100 feet per second and as fast as 1000 feet per second, immediately upon exiting the nozzle 64.

The velocity of a majority by weight of the impactors 100 may be substantially the same, or only slightly reduced, at the point of impact of an impactor 100 at the formation surface 66 as compared to when leaving the nozzle 64. Thus, it may be appreciated by those skilled in the art that due to the close proximity of a nozzle 64 to the formation being impacted, the velocity of a majority of impactors 100 exiting a nozzle 64 may be substantially the same as a velocity of an impactor 100 at a point of impact with the formation 52. Therefore, in many practical applications, the above velocity values may be determined or measured at substantially any point along the path between near an exit end of a nozzle 64 and the point of impact, without material deviation from the scope of this invention.

In addition to the impactors 100 satisfying the mass-velocity relationship described above, a substantial portion by weight of the solid material impactors 100 have an average mean diameter of equal to or less than approximately 0.100 inches.

To excavate a formation 52, the excavation implement, such as a drill bit 60 or impactor 100, must overcome minimum, in-situ stress levels or toughness of the formation 52. These minimum stress levels are known to typically range from a few thousand pounds per square inch, to in excess of 65,000 pounds per square inch. To fracture, cut, or plastically deform a portion of formation 52, force exerted on that portion of the formation 52 typically should exceed the minimum, in-situ stress threshold of the formation 52. When an impactor 100 first initiates contact with a formation, the unit stress exerted upon the initial contact point may be much higher than 10,000 pounds per square inch, and may be well in excess of one million pounds per square inch. The stress applied to the formation 52 during contact is governed by the force the impactor 100 contacts the formation with and the area of contact of the impactor with the formation. The stress is the force divided by the area of contact. The force is governed by Impulse Momentum theory whereby the time at which the contact occurs determines the magnitude of the force applied to the area of contact. In cases where the particle is contacting a relatively hard surface at an elevated velocity, the force of the particle when in contact with the surface is not constant, but is better described as a spike. However, the force need not be limited to any specific amplitude or duration. The magnitude of the spike load can be very large and occur in just a small fraction of the total impact time. If the area of contact is small the unit stress can reach values many times in excess of the in situ failure stress of the rock, thus guaranteeing fracture initiation and propagation and structurally altering the formation 52.

A substantial portion by weight of the solid material impactors 100 may apply at least 5000 pounds per square inch of unit stress to a formation 52 to create the structurally altered zone 124 in the formation. The structurally altered zone 124 is not limited to any specific shape or size, including depth or width. Further, a substantial portion by weight of the impactors 100 may apply in excess of 20,000 pounds per square inch of unit stress to the formation 52 to create the structurally altered zone 124 in the formation. The mass-velocity relationship of a substantial portion by weight of the plurality of solid material impactors 100 may also provide at least 30,000 pounds per square inch of unit stress.

A substantial portion by weight of the solid material impactors 100 may have any appropriate velocity to satisfy the mass-velocity relationship. For example, a substantial portion by weight of the solid material impactors may have a velocity of at least 100 feet per second when exiting the nozzle 64. A substantial portion by weight of the solid material impactors 100 may also have a velocity of at least 100 feet per second and as great as 1200 feet per second when exiting the nozzle 64. A substantial portion by weight of the solid material impactors 100 may also have a velocity of at least 100 feet per second and as great as 750 feet per second when exiting the nozzle 64. A substantial portion by weight of the solid material impactors 100 may also have a velocity of at least 350 feet per second and as great as 500 feet per second when exiting the nozzle 64.

Impactors 100 may be selected based upon physical factors such as size, projected velocity, impactor strength, formation 52 properties and desired impactor concentration in the circulation fluid. Such factors may also include; (a) an expenditure of a selected range of hydraulic horsepower across the one or more nozzles, (b) a selected range of circulation fluid velocities exiting the one or more nozzles or impacting the formation, and (c) a selected range of solid material impactor velocities exiting the one or more nozzles or impacting the formation, (d) one or more rock properties of the formation being excavated, or (e), any combination thereof.

If an impactor 100 is of a specific shape such as that of a dart, a tapered conic, a rhombic, an octahedral, or similar oblong shape, a reduced impact area to impactor mass ratio may be achieved. The shape of a substantial portion by weight of the impactors 100 may be altered, so long as the mass-velocity relationship remains sufficient to create a claimed structural alteration in the formation and an impactor 100 does not have any one length or diameter dimension greater than approximately 0.100 inches. Thereby, a velocity required to achieve a specific structural alteration may be reduced as compared to achieving a similar structural alteration by impactor shapes having a higher impact area to mass ratio. Shaped impactors 100 may be formed to substantially align themselves along a flow path, which may reduce variations in the angle of incidence between the impactor 100 and the formation 52. Such impactor shapes may also reduce impactor contact with the flow structures such those in the pipe string 55 and the excavation rig 5 and may thereby minimize abrasive erosion of flow conduits.

Referring to FIGS. 1-4, a substantial portion by weight of the impactors 100 may engage the formation 52 with sufficient energy to enhance creation of a wellbore 70 through the formation 52 by any or a combination of different impact mechanisms. First, an impactor 100 may directly remove a larger portion of the formation 52 than may be removed by abrasive-type particles. In another mechanism, an impactor 100 may penetrate into the formation 52 without removing formation material from the formation 52. A plurality of such formation penetrations, such as near and along an outer perimeter of the wellbore 70 may relieve a portion of the stresses on a portion of formation being excavated, which may thereby enhance the excavation action of other impactors 100 or the drill bit 60. Third, an impactor 100 may alter one or more physical properties of the formation 52. Such physical alterations may include creation of micro-fractures and increased brittleness in a portion of the formation 52, which may thereby enhance effectiveness the impactors 100 in excavating the formation 52. The constant scouring of the bottom of the borehole also prevents the build up of dynamic filter-cake, which can significantly increase the apparent toughness of the formation 52.

FIG. 2 illustrates an impactor 100 that has been impaled into a formation 52, such as a lower surface 66 in a wellbore 70. For illustration purposes, the surface 66 is illustrated as substantially planar and transverse to the direction of impactor travel 130. The impactors 100 circulated through a nozzle 64 may engage the formation 52 with sufficient energy to effect one or more properties of the formation 52.

A portion of the formation 52 ahead of the impactor 100 substantially in the direction of impactor travel 130 may be altered such as by micro-fracturing and/or thermal alteration due to the impact energy. In such occurrence, the structurally altered zone 124 may include an altered zone depth 132. An example of a structurally altered zone 124 is a compressive zone 102, which may be a zone in the formation 52 compressed by the impactor 100. The compressive zone 102 may have a length 134, but is not limited to any specific shape or size. The compressive zone 102 may be thermally altered due to impact energy.

An additional example of a structurally altered zone 124 near a point of impaction may be a zone of micro-fractures 106. The structurally altered zone 124 may be broken or otherwise altered due to the impactor 100 and/or a drill bit 60, such as by crushing, fracturing, or micro-fracturing 106.

Figure 3:
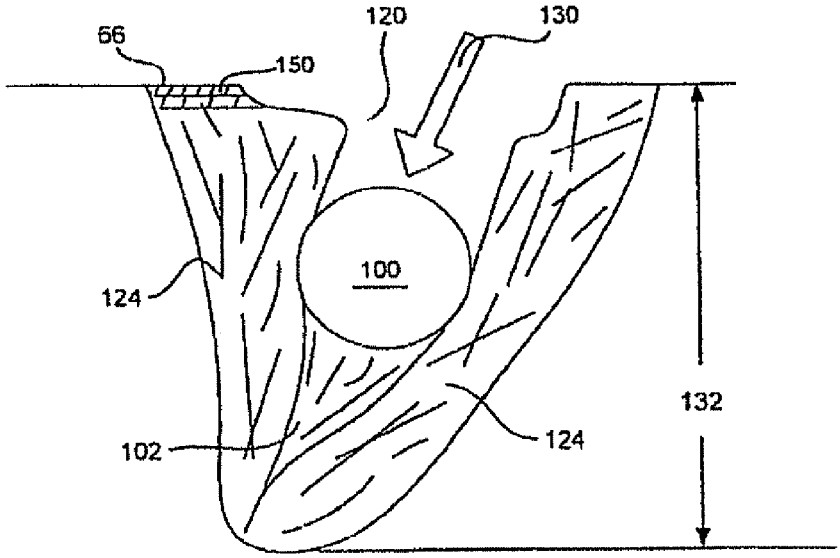
FIG. 3 illustrates an impactor embedded into the formation at an angle to a normalized surface plane of the target formation.
Figure 4:
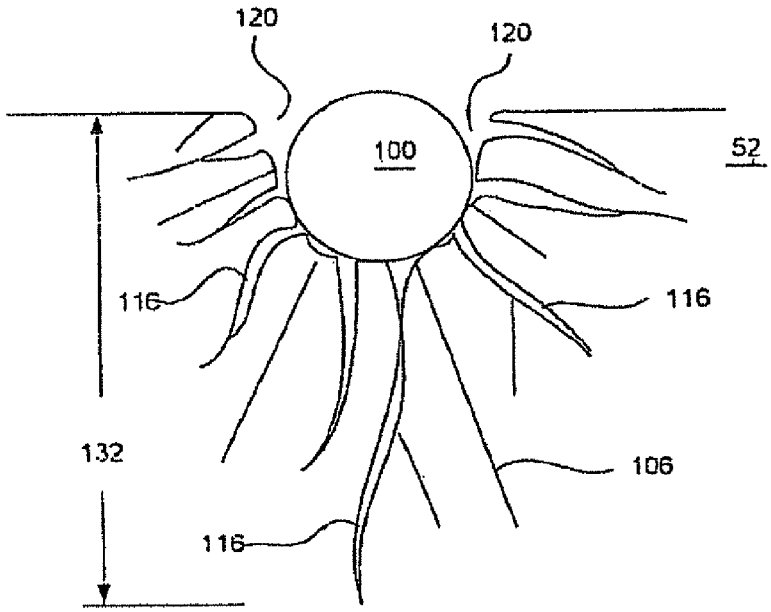
FIG. 4 illustrates an impactor impacting a formation with a plurality of fractures induced by the impact.

FIG. 2 also illustrates an impactor 100 implanted into a formation 52 and having created an excavation 120 wherein material has been ejected from or crushed beneath the impactor 100. Thereby an excavation may be created, which as illustrated in FIG. 3 may generally conform to the shape of the impactor 100. FIGS. 3 and 4 illustrate excavations 120 where the size of the excavation 120 may be larger than the size of the impactor 100. In FIG. 2, the impactor 100 is shown as impacted into the formation 52 yielding an excavation depth 109.

An additional theory for impaction mechanics in cutting a formation 52 may postulate that certain formations 52 may be highly fractured or broken up by impactor energy. FIG. 4 illustrates an interaction between an impactor 100 and a formation 52. A plurality of fractures 116 and micro-fractures 106 may be created in the formation 52 by impact energy.

An impactor 100 may penetrate a small distance into the formation 52 and cause the displaced or structurally altered formation 52 to "splay out" or be reduced to small enough particles for the particles to be removed or washed away by hydraulic action. Hydraulic particle removal may depend at least partially upon available hydraulic horsepower and at least partially upon particle wet-ability and viscosity. Such formation deformation may be a basis for fatigue failure of a portion of the formation by "impactor contact," as the plurality of solid material impactors 100 may displace formation material back and forth.

Each nozzle 64 may be selected to provide a desired circulation fluid circulation rate, hydraulic horsepower substantially at the nozzle 64, and/or impactor energy or velocity when exiting the nozzle 64. Each nozzle 64 may be selected as a function of at least one of (a) an expenditure of a selected range of hydraulic horsepower across the one or more nozzles 64, (b) a selected range of circulation fluid velocities exiting the one or more nozzles 64, and (c) a selected range of solid material impactor 100 velocities exiting the one or more nozzles 64.

To optimize ROP, it may be desirable to determine, such as by monitoring, observing, calculating, knowing, or assuming one or more excavation parameters such that adjustments may be made in one or more controllable variables as a function of the determined or monitored excavation parameter. The one or more excavation parameters may be selected from a group comprising: (a) a rate of penetration into the formation 52, (b) a depth of penetration into the formation 52, (c) a formation excavation factor, and (d) the number of solid material impactors 100 introduced into the circulation fluid per unit of time. Monitoring or observing may include monitoring or observing one or more excavation parameters of a group of excavation parameters comprising: (a) rate of nozzle rotation, (b) rate of penetration into the formation 52, (c) depth of penetration into the formation 52, (d) formation excavation factor, (e) axial force applied to the drill bit 60, (f) rotational force applied to the bit 60, (g) the selected circulation rate, (h) the selected pump pressure, and/or (i) wellbore fluid dynamics, including pore pressure.

One or more controllable variables or parameters, may be altered, including at least one of (a) rate of impactor 100 introduction into the circulation fluid, (b) impactor 100 size, (c) impactor 100 velocity, (d) drill bit nozzle 64 selection, (e) the selected circulation rate of the circulation fluid, (f) the selected pump pressure, and (g) any of the monitored excavation parameters.

To alter the rate of impactors 100 engaging the formation 52, the rate of impactor 100 introduction into the circulation fluid may be altered. The circulation fluid circulation rate may also be altered independent from the rate of impactor 100 introduction. Thereby, the concentration of impactors 100 in the circulation fluid may be adjusted separate from the fluid circulation rate. Introducing a plurality of solid material impactors 100 into the circulation fluid may be a function of impactor 100 size, circulation fluid rate, nozzle rotational speed, wellbore 70 size, and a selected impactor 100 engagement rate with the formation 52. The impactors 100 may also be introduced into the circulation fluid intermittently during the excavation operation. The rate of impactor 100 introduction relative to the rate of circulation fluid circulation may also be adjusted or interrupted as desired.

The plurality of solid material impactors 100 may be introduced into the circulation fluid at a selected introduction rate and/or concentration to circulate the plurality of solid material impactors 100 with the circulation fluid through the nozzle 64. The selected circulation rate and/or pump pressure, and nozzle selection may be sufficient to expend a desired portion of energy or hydraulic horsepower in each of the circulation fluid and the impactors 100.

An example of an operative excavation system 1 may comprise a bit 60 with an 8½" bit diameter. The solid material impactors 100 may be introduced into the circulation fluid at a rate of 12 gallons per minute. The circulation fluid containing the solid material impactors may be circulated through the bit 60 at a rate of 462 gallons per minute. A substantial portion by weight of the solid material impactors may have an average mean diameter of 0.100". The following parameters will result in approximately a 27 feet per hour penetration rate into Sierra White Granite. In this example, the excavation system 1 may produce 1413 solid material impactors 100 per cubic inch with approximately 3.9 million impacts per minute against the formation 52. On average, 0.00007822 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 1.14 Ft Lbs., thus satisfying the mass-velocity relationship described above.

Another example of an operative excavation system 1 may comprise a bit 60 with an 8½" bit diameter. The solid material impactors 100 may be introduced into the circulation fluid at a rate of 12 gallons per minute. The circulation fluid containing the solid material impactors may be circulated through the nozzle 64 at a rate of 462 gallons per minute. A substantial portion by weight of the solid material impactors may have an average mean diameter of 0.075". The following parameters will result in approximately a 35 feet per hour penetration rate into Sierra White Granite. In this example, the excavation system 1 may produce 3350 solid material impactors 100 per cubic inch with approximately 9.3 million impacts per minute against the formation 52. On average, 0.0000428 cubic inches of the formation 52 are removed per impactor 100 impact. The resulting exit velocity of a substantial portion of the impactors 100 from each of the nozzles 64 would average 495.5 feet per second. The kinetic energy of a substantial portion by weight of the solid material impacts 100 would be approximately 0.240 Ft Lbs., thus satisfying the mass-velocity relationship described above.

In addition to impacting the formation with the impactors 100, the bit 60 may be rotated while circulating the circulation fluid and engaging the plurality of solid material impactors 100 substantially continuously or selectively intermittently. The nozzle 64 may also be oriented to cause the solid material impactors 100 to engage the formation 52 with a radially outer portion of the bottom hole surface 66. Thereby, as the drill bit 60 is rotated, the impactors 100, in the bottom hole surface 66 ahead of the bit 60, may create one or more circumferential kerfs. The drill bit 60 may thereby generate formation cuttings more efficiently due to reduced stress in the surface 66 being excavated, due to the one or more substantially circumferential kerfs in the surface 66.

The excavation system 1 may also include inputting pulses of energy in the fluid system sufficient to impart a portion of the input energy in an impactor 100. The impactor 100 may thereby engage the formation 52 with sufficient energy to achieve a structurally altered zone 124. Pulsing of the pressure of the circulation fluid in the pipe string 55, near the nozzle 64 also may enhance the ability of the circulation fluid to generate cuttings subsequent to impactor 100 engagement with the formation 52.

Figure 5:
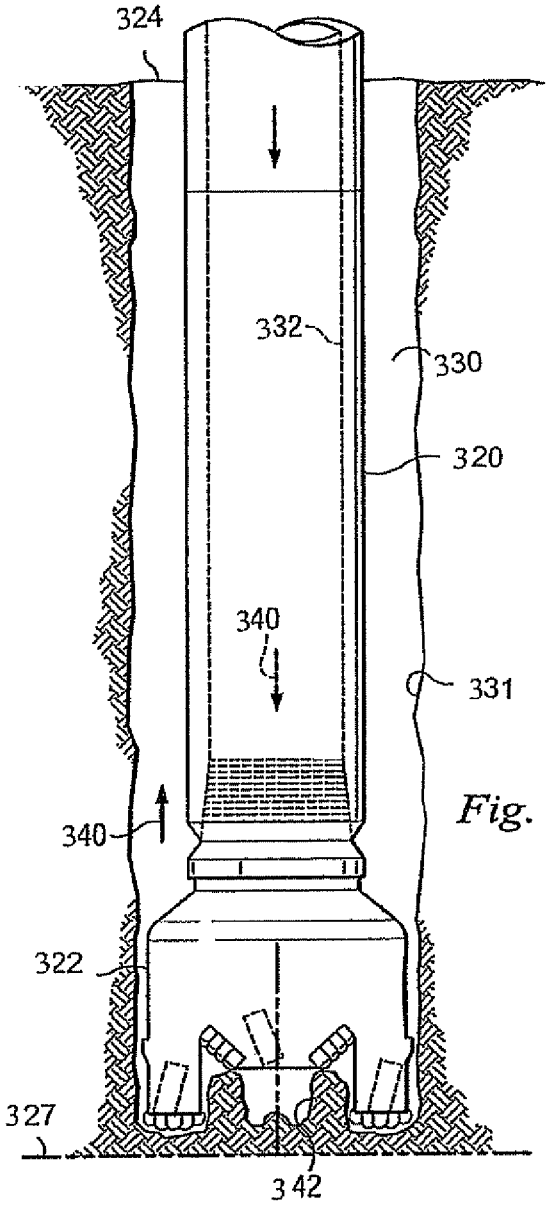
FIG. 5 is a side partial section view of a drill string with drill bit excavating a borehole.

FIG. 5 shows a first embodiment of a drill bit 322 at the bottom of a well bore 324 and attached to a drill string 320. The drill bit 322 acts upon a bottom surface 327 of the well bore 324. The drill string 320 has a central passage 332 that supplies drilling fluids 340 to the drill bit 322. The drill bit 322 uses the drilling fluids 340 aid solid material impactors when acting upon the bottom surface 327 of the well bore 324. The solid material impactors reduce bit balling and bottom balling by contacting the bottom surface 327 of the well bore 324 with the solid material impactors. The solid material impactors may be used for any type of contacting of the bottom surface 327 of the well bore 324, whether it be abrasion-type drilling, impact-type drilling, or any other drilling using solid material impactors. The drilling fluids 340 that have been used by the drill bit 322 on the bottom surface 327 of the well bore 324 exit the well bore 324 through a well bore annulus 324 between the drill string 320 and the inner wall 326 of the well bore 324. Particles of the bottom surface 327 removed by the drill bit 322 exit the well bore 324 with the drill fluid 340 through the well bore annulus 324. The drill bit 322 creates a rock ring 342 at the bottom surface 327 of the well bore 324.

Figure 6:
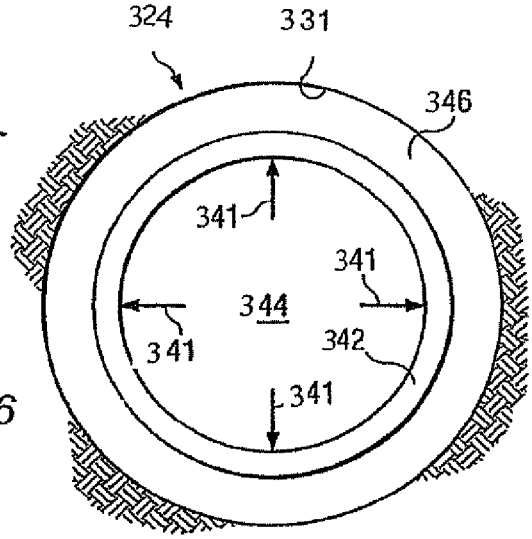
FIG. 6 is an overhead view of a rock ring formed on the borehole bottom.

Referring now to FIG. 6, a top view of the rock ring 342 formed by the drill bit 322 is illustrated. An interior cavity 344 is worn away by an interior portion of the drill bit 322 and the exterior cavity 346 and inner wall 326 of the well bore 324 are worn away by an exterior portion of the drill bit 322. The rock ring 342 possesses hoop strength, which holds the rock ring 342 together and resists breakage. The hoop strength of the rock ring 342 is typically much less than the strength of the bottom surface 327 or the inner wall 326 of the well bore 324, thereby making the drilling of the bottom surface 327 less demanding on the drill bit 322. By applying a compressive load and a side load, shown with arrows 341, on the rock ring 342, the drill bit 322 causes the rock ring 342 to fracture. The drilling fluid 340 then washes the residual pieces of the rock ring 342 back up to the surface through the well bore annulus 324.

Remaining with FIG. 6, mechanical cutters, utilized on many of the surfaces of the drill bit 322, may be any type of protrusion or surface used to abrade the rock formation by contact of the mechanical cutters with the rock formation. The mechanical cutters may be Polycrystalline Diamond Coated (PDC), or any other suitable type mechanical cutter such as tungsten carbide cutters. The mechanical cutters may be formed in a variety of shapes, for example, hemispherically shaped, cone shaped, etc. Several sizes of mechanical cutters are also available, depending on the size of drill bit used and the hardness of the rock formation being cut.

Figure 7:
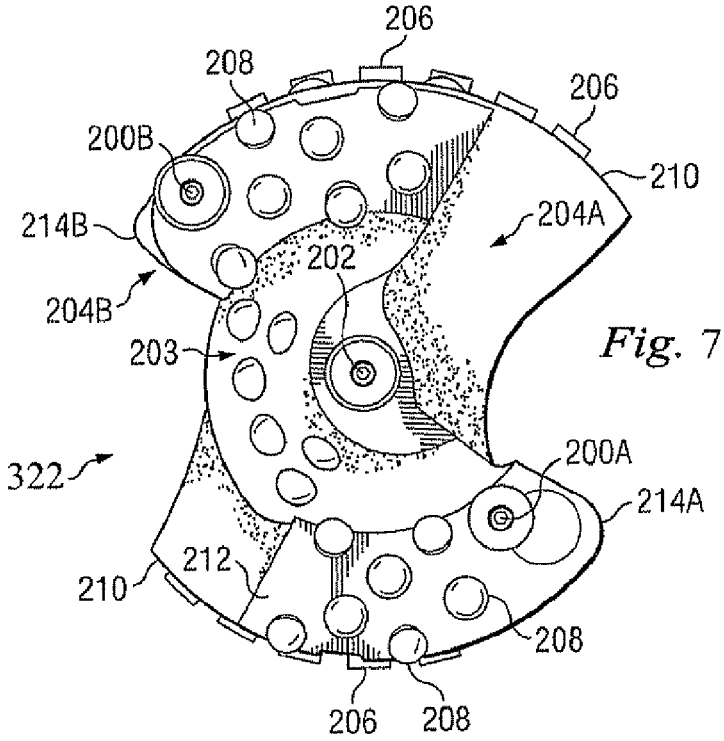
FIGS. 7-8 illustrate embodiments of the drill bit of FIG. 5 in upward looking perspective views.

Referring now to FIG. 7, an end elevational view of the drill bit 322 of FIG. 5 is illustrated. The drill bit 322 comprises two side nozzles 200A, 200B and a center nozzle 202. The side and center nozzles 200A, 200B, 202 discharge drilling fluid and solid material impactors (not shown) into the rock formation, or other surface being excavated. The solid material impactors may comprise steel shot ranging in diameter from about 0.010 to about 0.500 of an inch. However, various diameters and materials such as ceramics, etc. may be utilized in combination with the drill bit 322. The solid material impactors contact the bottom surface 327 of the well bore 324 and are circulated through the annulus 324 to the surface. The solid material impactors may also make up any suitable percentage of the drill fluid for drilling through a particular formation.

Still referring to FIG. 7, the center nozzle 202 is located in a center portion 203 of the drill bit 322. The center nozzle 202 may be angled to the longitudinal axis of the drill bit 322 to create an interior cavity 344 and also cause the rebounding solid material impactors to flow into the major junk slot 204A. The side nozzle 200A located on a side arm 214A of the drill bit 322 may also be oriented to allow the solid material impactors to contact the bottom surface 327 of the well bore 324 and then rebound into the major junk slot 204A. The second side nozzle 200B is located on a second side arm 214B. The second side nozzle 200B may be oriented to allow the solid material impactors to contact the bottom surface 327 of the well bore 324 and then rebound into a minor junk slot 204B. The orientation of the side nozzles 200A, 200B may be used to facilitate the drilling of the large exterior cavity 346. The side nozzles 200A, 200B may be oriented to cut different portions of the bottom surface 327. For example, the side nozzle 200B may be angled to cut the outer portion of the exterior cavity 346 and the side nozzle 200A may be angled to cut the inner portion of the exterior cavity 346. The major and minor junk slots 204A, 204B allow the solid material impactors, cuttings, and drilling fluid 340 to flow up through the well bore annulus 324 back to the surface. The major and minor junk slots 204A, 204B are oriented to allow the solid material impactors and cuttings to freely flow from the bottom surface 327 to the annulus 324.

As described earlier, the drill bit 322 may also comprise mechanical cutters and gauge cutters. Various mechanical cutters are shown along the surface of the drill bit 322. Hemispherical PDC cutters are interspersed along the bottom face and the side walls 210 of the drill bit 322. These hemispherical cutters along the bottom face break down the large portions of the rock ring 342 and also abrade the bottom surface 327 of the well bore 324. Another type of mechanical cutter along the side arms 214A, 214B are gauge cutters 230. The gauge cutters 230 form the final diameter of the well bore 324. The gauge cutters 230 trim a small portion of the well bore 324 not removed by other means. Gauge bearing surfaces 206 are interspersed throughout the side walls 210 of the drill bit 322. The gauge bearing surfaces 206 ride in the well bore 324 already trimmed by the gauge cutters 230. The gauge bearing surfaces 206 may also stabilize the drill bit 322 within the well bore 324 and aid in preventing vibration.

Still referring to FIG. 7, the center portion 203 comprises a breaker surface, located near the center nozzle 202, comprising mechanical cutters 208 for loading the rock ring 342. The mechanical cutters 208 abrade and deliver load to the lower stress rock ring 342. The mechanical cutters 208 may comprise PDC cutters, or any other suitable mechanical cutters. The breaker surface is a conical surface that creates the compressive and side loads for fracturing the rock ring 342. The breaker surface and the mechanical cutters 208 apply force against the inner boundary of the rock ring 342 and fracture the rock ring 342. Once fractured, the pieces of the rock ring 342 are circulated to the surface through the major and minor junk slots 204A, 204B.

Figure 8:
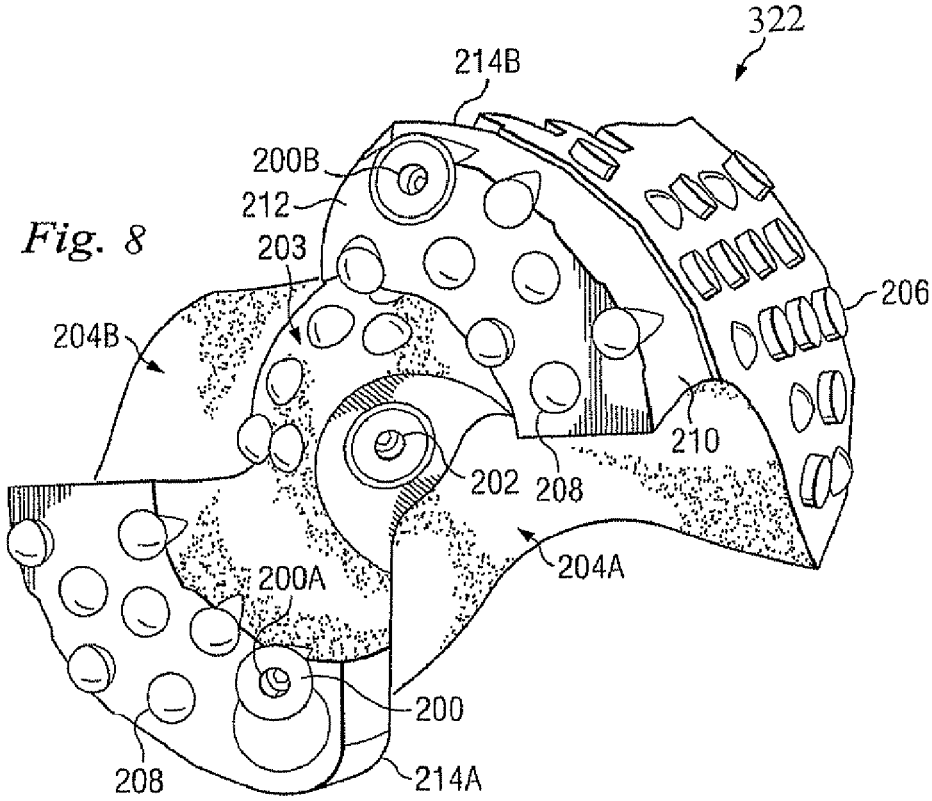

Referring now to FIG. 8, an enlarged end elevational view of the drill bit 322 is shown. As shown more clearly in FIG. 8, the gauge bearing surfaces 206 and mechanical cutters 208 are interspersed on the outer side walls 210 of the drill bit 322. The mechanical cutters 208 along the side walls 210 may also aid in the process of creating drill bit 322 stability and also may perform the function of the gauge bearing surfaces 206 if they fail. The mechanical cutters 208 are oriented in various directions to reduce the wear of the gauge bearing surface 206 and also maintain the correct well bore 324 diameter. As noted with the mechanical cutters 208 of the breaker surface, the solid material impactors fracture the bottom surface 327 of the well bore 324 and, as such, the mechanical cutters 208 remove remaining ridges of rock and assist in the cutting of the bottom hole. However, the drill bit 322 need not necessarily comprise the mechanical cutters 208 on the side wall 210 of the drill bit 322.

Figure 9:
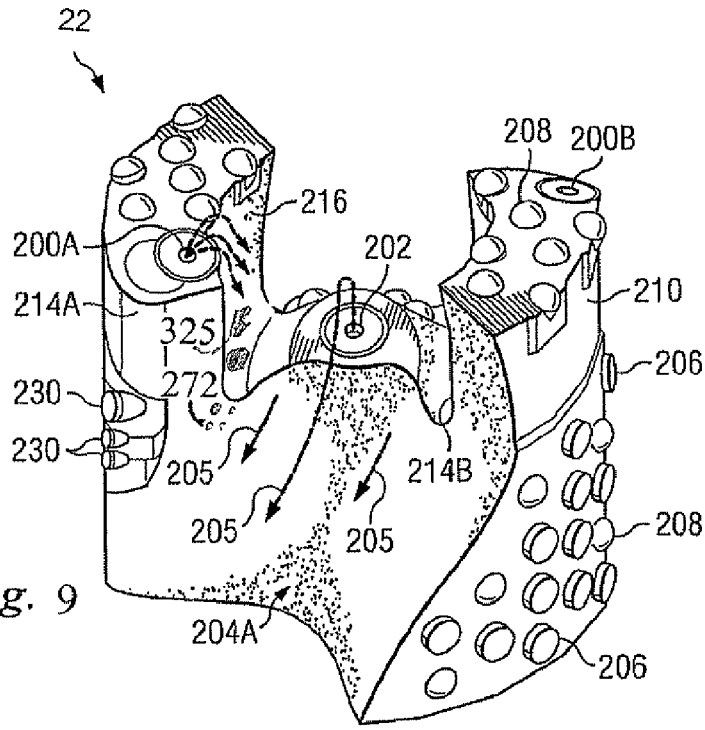
FIGS. 9-11 illustrate embodiments of the drill bit of FIG. 5 in side perspective views.

Referring now to FIG. 9, a side elevational view of the drill bit 322 is illustrated. FIG. 9 shows the gauge cutters 230 included along the side arms 214A, 214B of the drill bit 322. The gauge cutters 230 are oriented so that a cutting face of the gauge cutter 230 contacts the inner wall 326 of the well bore 324. The gauge cutters 230 may contact the inner wall 326 of the well bore at any suitable backrake, for example a backrake of 15° to 45°. Typically, the outer edge of the cutting face scrapes along the inner wall 326 to refine the diameter of the well bore 324.

Still referring to FIG. 9, one side nozzle 200A is disposed on an interior portion of the side arm 214A and the second side nozzle 20013 is disposed on an exterior portion of the opposite side arm 214B. Although the side nozzles 200A, 200B are shown located on separate side arms 214A, 21413 of the drill bit 322, the side nozzles 200A, 200B may also be disposed on the same side arm 214A or 214B. Also, there may only be one side nozzle, 200A or 200B. Also, there may only be one side arm, 214A or 214B.

Each side arm 214A, 214B fits in the exterior cavity 346 formed by the side nozzles 200A, 200B and the mechanical cutters 208 on the face 212 of each side arm 214A, 214B. The solid material impactors 100 from one side nozzle 200A rebound from the rock formation and combine with the drilling fluid and cuttings 325 flow to the major junk slot 204A and up to the annulus 324. The flow of the solid material impactors, shown by arrows 205, from the center nozzle 202 also rebound from the rock formation up through the major junk slot 204A.

Figure 10:
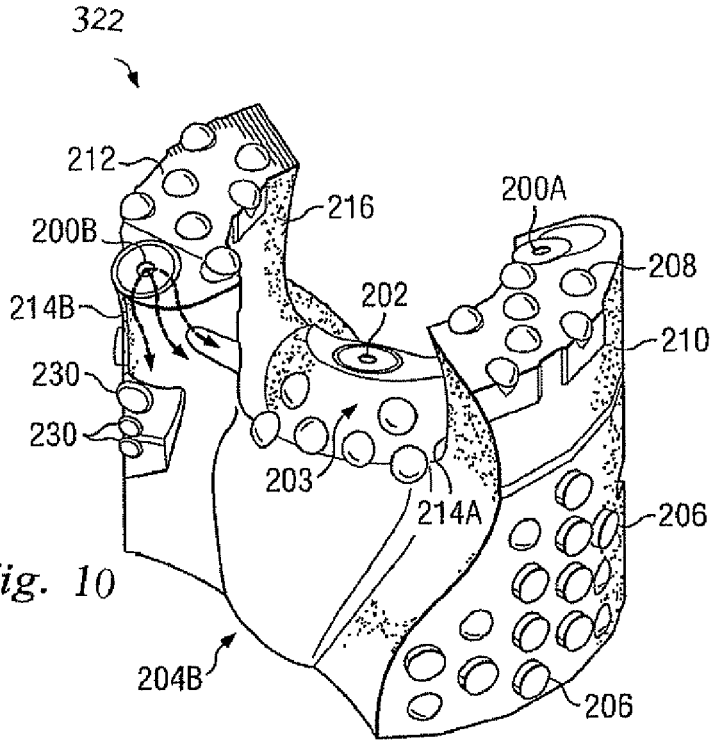
Figure 11:
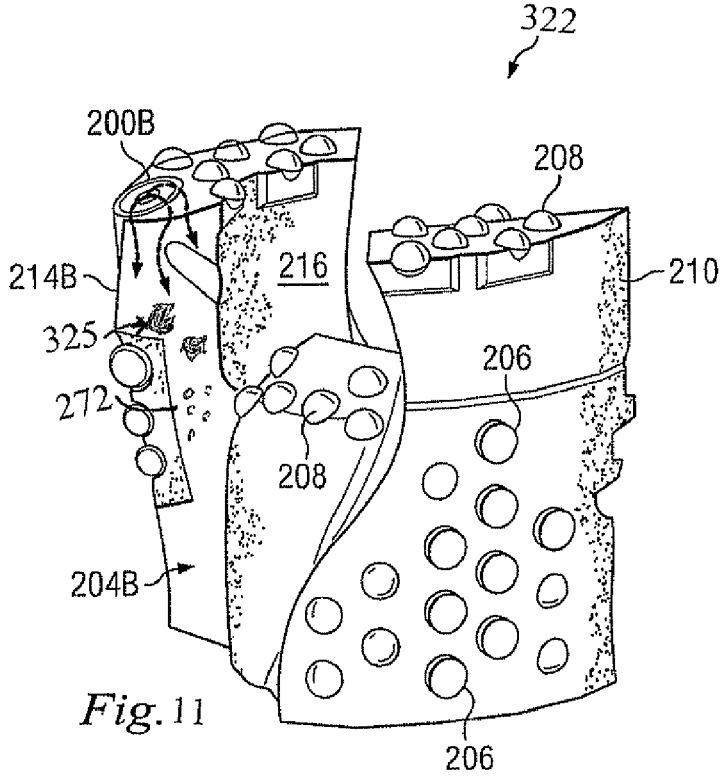

Referring now to FIGS. 10 and 11, the minor junk slot 204B, breaker surface, and the second side nozzle 200B are shown in greater detail. The breaker surface is conically shaped, tapering to the center nozzle 202. The second side nozzle 200B is oriented at an angle to allow the outer portion of the exterior cavity 346 to be contacted with solid material impactors. The solid material impactors then rebound up through the minor junk slot 204B, shown by arrows 205, along with any cuttings 325 and drilling fluid 340 associated therewith.

Figure 12:
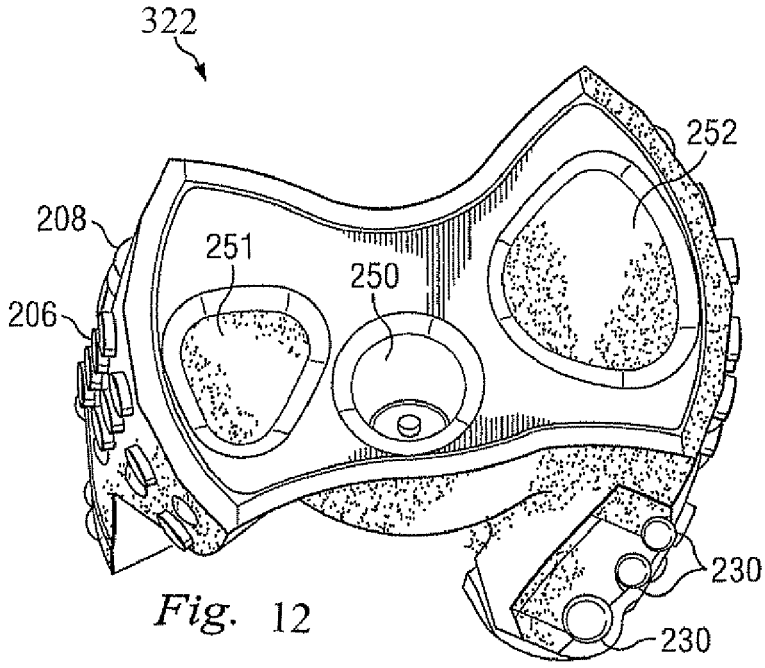

Referring now to FIGS. 12 and 13, top elevational views of the drill bit 322 are shown. Each nozzle 200A, 200B, 202 receives drilling fluid 340 and solid material impactors from a common plenum feeding separate cavities 250, 251, and 252. The center cavity 250 feeds drilling fluid 340 and solid material impactors to the center nozzle 202 for contact with the rock formation. The side cavities 251, 252 are formed in the interior of the side anus 214A, 214B of the drill bit 322, respectively. The side cavities 251, 252 provide drilling fluid 340 and solid material impactors to the side nozzles 200A, 200B for contact with the rock formation. By utilizing separate cavities 250, 251, 252 for each nozzle 202, 200A, 200B, the percentages of solid material impactors in the drilling fluid 340 and the hydraulic pressure delivered through the nozzles 200A, 200B, 202 can be specifically tailored for each nozzle 200A, 200B, 202. Solid material impactor distribution can also be adjusted by changing the nozzle diameters of the side and center nozzles 200A, 200B, and 202. However, in alternate embodiments, other arrangements of the cavities 250, 251, 252, or the utilization of a single cavity, are possible.

Referring now to FIG. 14, the drill bit 322 in engagement with the rock formation 270 is shown. As previously discussed, the solid material impactors 272 flow from the nozzles 200A, 200B, 202 and make contact with the rock formation 270 to create the rock ring 342 between the side arms 214A, 214B of the drill bit 322 and the center nozzle 202 of the drill bit 322. The solid material impactors 272 from the center nozzle 202 create the interior cavity 344 while the side nozzles 200A, 200B create the exterior cavity 346 to form the outer boundary of the rock ring 342. The gauge cutters 230 refine the more crude well bore 324 cut by the solid material impactors 272 into a well bore 324 with a more smooth inner wall 326 of the correct diameter.

Still referring to FIG. 15, the solid material impactors 272 flow from the first side nozzle 200A between the outer surface of the rock ring 342 and the interior wall 216 in order to move up through the major junk slot 204A to the surface. The second side nozzle 200B (not shown) emits solid material impactors 272 that rebound toward the outer surface of the rock ring 342 and to the minor junk slot 204B (not shown). The solid material impactors 272 from the side nozzles 200A, 200B may contact the outer surface of the rock ring 342 causing abrasion to further weaken the stability of the rock ring 342. Recesses 274 around the breaker surface of the drill bit 322 may provide a void to allow the broken portions of the rock ring 342 to flow from the bottom surface 327 of the well bore 324 to the major or minor junk slot 204A, 204B.

Referring now to FIG. 15, example orientations of the nozzles 200A, 200B, 202 are illustrated. The center nozzle 202 is disposed left of the center line of the drill bit 322 and angled on the order of around 20° left of vertical. Alternatively, both of the side nozzles 200A, 200B may be disposed on the same side arm 214 of the drill bit 322 as shown in FIG. 15. In this embodiment, the first side nozzle 200A, oriented to cut the inner portion of the exterior cavity 346, is angled on the order of around 10° left of vertical. The second side nozzle 200B is oriented at an angle on the order of around 14° right of vertical. This particular orientation of the nozzles allows for a large interior cavity 344 to be created by the center nozzle 202. The side nozzles 200A, 200B create a large enough exterior cavity 346 in order to allow the side arms 214A, 214B to fit in the exterior cavity 346 without incurring a substantial amount of resistance from uncut portions of the rock formation 270. By varying the orientation of the center nozzle 202, the interior cavity 344 may be substantially larger or smaller than the interior cavity 344 illustrated in FIG. 14.

The side nozzles 200A, 200B may be varied in orientation in order to create a larger exterior cavity 346, thereby decreasing the size of the rock ring 342 and increasing the amount of mechanical cutting required to drill through the bottom surface 327 of the well bore 324. Alternatively, the side nozzles 200A, 200B may be oriented to decrease the amount of the inner wall 326 contacted by the solid material impactors 272. By orienting the side nozzles 200A, 200B at, for example, a vertical orientation, only a center portion of the exterior cavity 346 would be cut by the solid material impactors and the mechanical cutters would then be required to cut a large portion of the inner wall 326 of the well bore 324.

Referring now to FIGS. 16 and 17, side cross-sectional views of the bottom surface 327 of the well bore 324 drilled by the drill bit 322 are shown. With the center nozzle angled on the order of around 20° left of vertical and the side nozzles 200A, 200B angled on the order of around 10° left of vertical and around 14° right of vertical, respectively, the rock ring 342 is formed. By increasing the angle of the side nozzle 200A, 200B orientation, an alternate rock ring 342 shape and bottom surface 327 is cut as shown in FIG. 17. The interior cavity 344 and rock ring 342 are much shallower as compared with the rock ring 342 in FIG. 16. By differing the shape of the bottom surface 327 and rock ring 342, more stress is placed on the gauge bearing surfaces 206, mechanical cutters 208, and gauge cutters 230.

Although the drill bit 322 is described comprising orientations of nozzles and mechanical cutters, any orientation of either nozzles, mechanical cutters, or both may be utilized. The drill bit 322 need not comprise a center portion 203. The drill bit 322 also need not even create the rock ring 342. For example, the drill bit may only comprise a single nozzle and a single junk slot. Furthermore, although the description of the drill bit 322 describes types and orientations of mechanical cutters, the mechanical cutters may be formed of a variety of substances, and formed in a variety of shapes.

Each combination of formation type, bore hole size, bore hole depth, available weight on bit, bit rotational speed, pump rate, hydrostatic balance, circulation fluid rheology, bit type, and tooth/cutter dimensions may create many combinations of optimum impactor presence or concentration, and impactor energy requirements. The methods and systems of this invention facilitate adjusting impactor size, mass, introduction rate, circulation fluid rate and/or pump pressure, and other adjustable or controllable variables to determine and maintain an optimum combination of variables. The methods and systems of this invention also may be coupled with select bit nozzles, downhole tools, and fluid circulating and processing equipment to effect many variations in which to optimize rate of penetration.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A system for excavating a borehole through a subterranean formation comprising:

a supply of pressurized fluid mixed with impactors whose mean diameter is between 0.075 inches and 0.100 inches of a substantial portion by their weight;

a drill string in a borehole in communication with the pressurized fluid mixed with impactors;

a drill bit disposed on a lower end of the drill string;

nozzles disposed on the bit that direct the supply of pressurized fluid mixed with impactors from the drill string into excavating contact with the borehole; and a first junk slot defined between a lateral side of the drill bit and a surface of the borehole, wherein the nozzles have an orientation configured so that impactors directed into excavating contact rebound from the borehole through the junk slot to avoid erosion of the drill bit.

2. The system of claim 1, further comprising a second junk slot in the drill bit.

3. The system of claim 2, wherein at least one nozzle is oriented so that impactors exiting that nozzle contact the borehole bottom surface and rebound into the second junk slot.

4. The system of claim 1, further comprising a pump with an outlet having the pressurized fluid exiting the outlet, and a supply line connected between the pump outlet and the drill string.

5. The system of claim 1 further comprising an impactor supply discharging impactors into a supply line.

6. The system of claim 1, wherein the impactors are substantially spherical, substantially non-abrasive, and substantially rigid.

7. The system of claim 1, wherein the impactors exiting the nozzles have a minimum average kinetic energy so that contacting the formation with the impactors compresses the formation to fracture and structurally alter the formation.

8. The system of claim 7, wherein cutting fragments are broken from the formation by the impactors' contact and wherein the cutting fragments flow through the first junk slot with the slurry and impactors that rebound from the formation surface.

9. The system of claim 1, wherein at least one nozzle is oriented to discharge from the bit bottom so that rotating the bit excavates a region of the borehole bottom adjacent the borehole outer circumference and wherein at least one nozzle is oriented to discharge from the bit bottom so that rotating the bit excavates a region of the borehole bottom adjacent the borehole axis thereby forming a rock ring on the borehole bottom.

10. The system of claim 9, further comprising arms projecting from the bit and cutters on the arms, so that rotatingly contacting the rock ring with the arms fractures the rock ring.

11. A borehole excavating system comprising;

a pump that pressurizes a circulating fluid and discharges the circulating fluid;

a supply line with an inlet connected to a discharge of the pump and an outlet in fluid communication with a drill string disposed in a borehole;

a supply of impactors with mean diameters is between 0.075 inches and 0.100 inches;

an impactor injection port disposed in fluid communication with the supply line for introducing the impactors into the circulating fluid in the supply line so that a mixture of circulating fluid and impactors flows in the supply line towards the drill string downstream of the impactor injection port;

a drill bit in the borehole disposed on an end of the drill string;

nozzles disposed on the drill bit in fluid communication with the drill string to thereby receive the mixture of circulating fluid and impactors and that direct the mixture into excavating contact with the borehole; and a junk slot defined between a lateral side of the drill bit and a surface of the borehole, wherein the nozzles have an orientation configured so that the impactors directed into excavating contact rebound from the borehole through the junk slot to avoid erosion of the drill bit.

12. A method of excavating a borehole through a subterranean formation comprising:

a) disposing a drill string in the borehole, the drill string including a drill bit having nozzles on a lower end of the drill bit that are in fluid communication with the drill string and a lateral side that cooperatively defines a junk slot with a surface of the borehole;

b) forming a mixture of pressurized fluid and impactors having diameters between 0.075 inches and 0.100 inches;

c) directing the mixture through the drill string so that the mixture flows to the drill bit and exits the nozzles; and d) orienting the nozzles so that the impactors in the mixture contact the formation and rebound from the formation through the junk slot to avoid erosion of the drill bit.

13. The method of claim 12, further comprising forming a rock ring on the borehole bottom by discharging the mixture from the nozzles in concentric circular patterns and fracturing the rock ring by compressive contact with the drill bit.

14. The method of claim 12, wherein contacting the formation with the impactors compresses the formation to fracture and structurally alter the formation to thereby excavate the borehole.

* * * * *